US009268285B2

(12) United States Patent
Sugiyama et al.

(10) Patent No.: US 9,268,285 B2
(45) Date of Patent: Feb. 23, 2016

(54) IMAGE FORMING APPARATUS

(71) Applicants: Kyoko Sugiyama, Obu (JP); Junki Ueyama, Nagoya (JP); Yusuke Murodate, Nagoya (JP)

(72) Inventors: Kyoko Sugiyama, Obu (JP); Junki Ueyama, Nagoya (JP); Yusuke Murodate, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/836,571

(22) Filed: Mar. 15, 2013

(65) Prior Publication Data

US 2013/0259553 A1 Oct. 3, 2013

(30) Foreign Application Priority Data

Mar. 30, 2012 (JP) ..... 2012-080575
Oct. 12, 2012 (JP) ..... 2012-226810

(51) Int. Cl.
*B65H 1/08* (2006.01)
*G03G 15/00* (2006.01)
*B65H 1/04* (2006.01)

(52) U.S. Cl.
CPC ..... *G03G 15/6529* (2013.01); *G03G 15/6511* (2013.01); *B65H 1/04* (2013.01); *B65H 2405/1117* (2013.01); *B65H 2405/1124* (2013.01)

(58) Field of Classification Search
CPC ..... B65H 2405/1117; B65H 2405/1124; B65H 2405/11162
USPC ..... 271/147, 157, 171
See application file for complete search history.

(56) References Cited

U.S. PATENT DOCUMENTS 5,895,038 A 4/1999 Takashima
5,984,297 A 11/1999 Tanaka
6,000,689 A 12/1999 Furuki et al.
6,039,315 A 3/2000 Lim
6,328,301 B1 12/2001 Tsujii et al.

(Continued)

FOREIGN PATENT DOCUMENTS

AU 6070498 A 10/1999
GB 2121769 A 1/1984

(Continued)

OTHER PUBLICATIONS

Non Final Office Action issued in U.S. Appl. No. 13/836,915, mailed Sep. 5, 2013.

(Continued)

*Primary Examiner* — Howard Sanders
(74) *Attorney, Agent, or Firm* — Banner & Witcoff, Ltd.

(57) ABSTRACT

An image forming apparatus includes an image forming portion configured to form an image on a recording sheet, a main body including a pair of frames and a bridging member connecting the pair of frames, a feed roller, a sheet receiving plate, and a lifting member. The sheet receiving plate is configured to receive the recording sheet, and pivot between a nearby position where the sheet receiving plate is disposed near the feed roller and a remote position where the sheet receiving plate is disposed remote from the feed roller. The lifting member is disposed opposite to the feed roller relative to the sheet receiving plate and configured to lift the sheet receiving plate such that the sheet receiving plate is disposed in the nearby position. The lifting member includes a pivot shaft rotatably supported by the bridging member and a lift portion configured to contact the sheet receiving plate.

20 Claims, 14 Drawing Sheets

(56) References Cited

U.S. PATENT DOCUMENTS

| | | | | |
|---|---|---|---|---|
| 6,550,759 | B2 | 4/2003 | Kotaka et al. | |
| 7,270,323 | B2 | 9/2007 | Somemiya | |
| 7,494,120 | B2 | 2/2009 | Shimizu et al. | |
| 7,594,649 | B2 | 9/2009 | Liu et al. | |
| 7,708,265 | B2 * | 5/2010 | Kusama | 271/117 |
| 7,940,428 | B2 * | 5/2011 | Shimizu | 358/3.32 |
| 8,588,673 | B2 | 11/2013 | Hayakawa et al. | |
| 8,708,331 | B2 * | 4/2014 | Ueyama | B65H 3/0607 271/126 |
| 2001/0028141 | A1 | 10/2001 | Kotaka et al. | |
| 2006/0071402 | A1 | 4/2006 | Takasaka et al. | |
| 2006/0157914 | A1 | 7/2006 | Suwa | |
| 2006/0180986 | A1 * | 8/2006 | Hattori | 271/110 |
| 2007/0001376 | A1 | 1/2007 | Lim et al. | |
| 2007/0170642 | A1 | 7/2007 | Shimizu | |
| 2007/0176351 | A1 * | 8/2007 | Izuchi et al. | 271/118 |
| 2008/0048384 | A1 | 2/2008 | Kusama | |
| 2012/0043714 | A1 * | 2/2012 | Hamaguchi et al. | 271/10.09 |
| 2012/0235347 | A1 | 9/2012 | Takiguchi | |
| 2013/0207337 | A1 | 8/2013 | Tokisawa et al. | |

FOREIGN PATENT DOCUMENTS

| | | | |
|---|---|---|---|
| JP | 62-008245 | | 1/1987 |
| JP | 63-001822 | | 1/1988 |
| JP | 02-120436 | | 9/1990 |
| JP | 02-120436 | U | 9/1990 |
| JP | 10-120197 | A | 5/1998 |
| JP | 3272572 | B2 | 4/2002 |
| JP | 2004-168498 | A | 6/2004 |
| JP | 2007-176696 | A | 7/2007 |
| KR | 10-0258944 | B1 | 6/2000 |

OTHER PUBLICATIONS

Notice of Allowance issued in corresponding U.S. Appl. No. 13/836,915, mailed Dec. 12, 2013.

Feb. 25, 2015—(CN) First Office Action and Search Report—App 201310091159.4.

Feb. 25, 2015—(CN) First Office Action and Search Report—App 201310091217.3.

Sep. 14, 2015—(CN) Notification of the Second Office Action—App 201310091159.4, Eng Tran.

Co Pending U.S. Appl. No. 13/836,915, filed Mar. 15, 2013.

* cited by examiner

Fig.7A
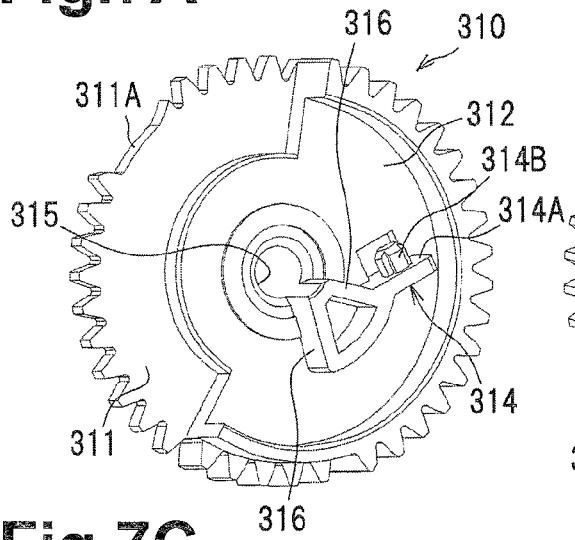
Fig.7B
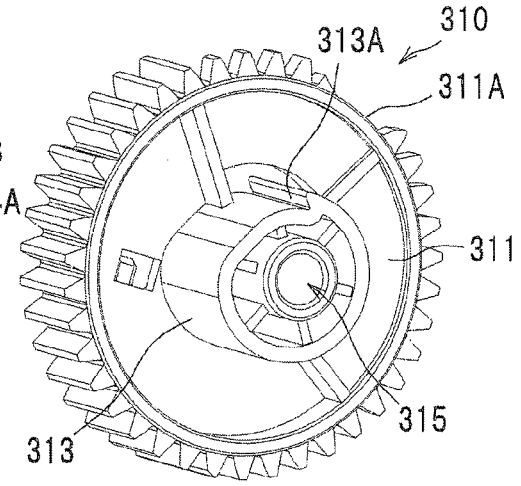
Fig.7C
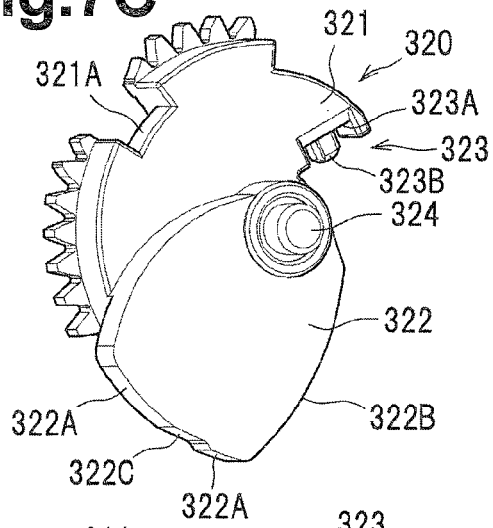
Fig.7D
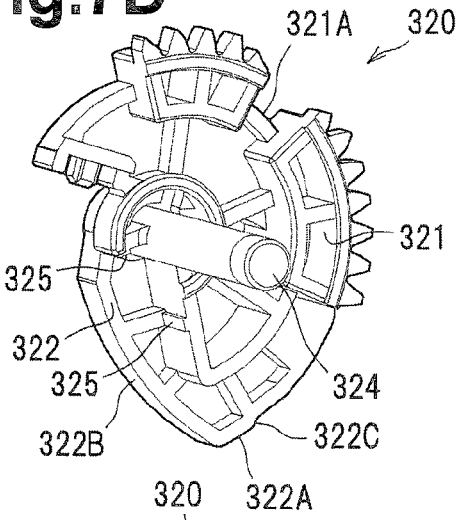
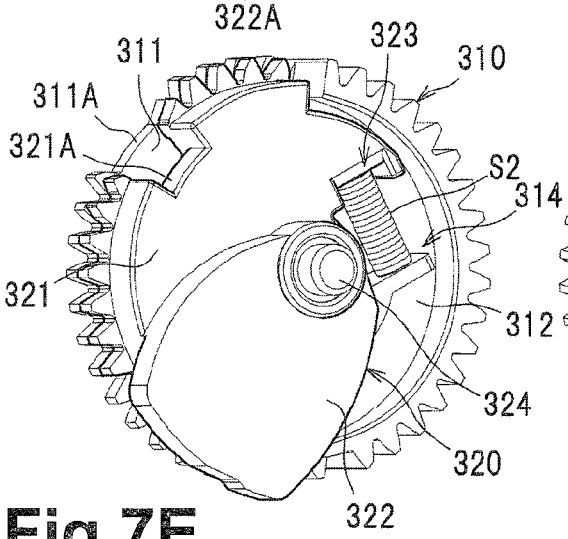
Fig.7E
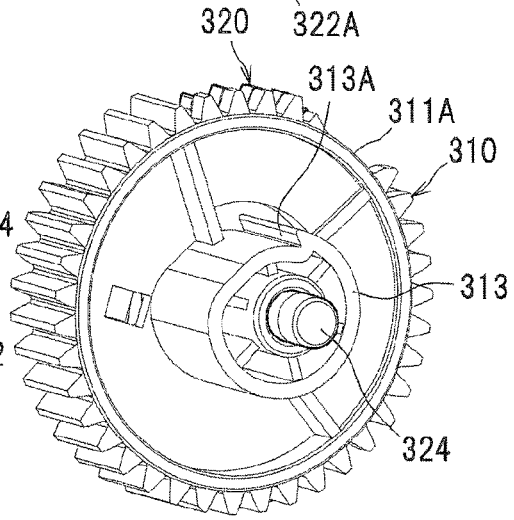
Fig.7F

IMAGE FORMING APPARATUS

CROSS REFERENCE TO RELATED APPLICATION

This application claims priority from Japanese Patent Application Nos. 2012-080575 filed on Mar. 30, 2012, and 2012-226810 filed on Oct. 12, 2012, which are incorporated herein by reference in their entireties.

FIELD

Aspects of the disclosure relate to an image forming apparatus including a sheet supply roller and a sheet receiving plate configured to receive a recording sheet thereon and raise the recording sheet toward the sheet supply roller.

BACKGROUND

A known image forming apparatus, which is configured to form an image on a recording sheet to be fed, includes a sheet supply roller, and a sheet receiving plate configured to receive the recording sheet thereon and raise the recording sheet toward the sheet supply roller from below. In this image forming apparatus, a first end portion of the sheet receiving plate is disposed under the sheet supply roller and a second end portion thereof is rotatably supported by a main body of the image forming apparatus such that the first end portion is vertically movable. A spring is disposed under the first end portion of the sheet receiving plate to urge the first end portion upward. The main body includes cams configured to contact opposite ends of the sheet receiving plate in a width direction of the recording sheet and regulate upward movement of the sheet receiving plate against an urging force of the spring. The first end portion of the sheet receiving plate moves vertically along with rotation of the cams.

SUMMARY

However, when the first end portion of the sheet receiving plate is located in the lowest position, the spring is under compression in the above art. As the spring has a certain degrees of height even if it is under compression, the physical size of the main body has been increased accordingly.

Illustrative aspects of the disclosure provide an image forming apparatus making a main body of the image forming apparatus compact.

According to an aspect of the disclosure, an image forming apparatus includes an image forming portion configured to form an image on a recording sheet, a main body including a pair of frames and a bridging member connecting the pair of frames, a feed roller, a sheet receiving plate, and a lifting member. The sheet receiving plate is configured to receive the recording sheet, and pivot between a nearby position where the sheet receiving plate is disposed near the feed roller and a remote position where the sheet receiving plate is disposed remote from the feed roller. The lifting member is disposed opposite to the feed roller relative to the sheet receiving plate and configured to lift the sheet receiving plate such that the sheet receiving plate is disposed in the nearby position. The lifting member includes a pivot shaft rotatably supported by the bridging member and a lift portion configured to contact the sheet receiving plate.

BRIEF DESCRIPTION OF THE DRAWINGS

Illustrative aspects will be described in detail with reference to the following figures in which like elements are labeled with like numbers and in which:

FIGS. 6A, 6B, and 6C illustrate the bridging member and a lifting member, wherein FIG. 6A is a perspective view illustrating the lifting member in a second position, FIG. 6B is a perspective view illustrating the lifting member in a first position, and FIG. 6C is a sectional view taken along a line V-V illustrating a rotational shaft and a support portion;

FIG. 7A is a perspective view of a first gear;

FIG. 7B is a perspective view of an opposite side of the first gear from that shown in FIG. 7A;

FIG. 7C is a perspective view of a second gear;

FIG. 7D is a perspective view of an opposite side of the second gear from that shown in FIG. 7C;

FIG. 7E is a perspective view of the first gear and the second gear;

FIG. 7F is a perspective view of an opposite side of the first gear and the second gear from that shown in FIG. 7E;

DETAILED DESCRIPTION

A first illustrative embodiment will be described in detail with reference to the accompanying drawings. In the following description, a general structure of a laser printer as an example of an image forming apparatus will be described and then features of the disclosure will be described in detail.

In the following description, orientations or sides of the laser printer will be identified based on the laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top-bottom direction may be referred to as a vertical direction.

Figure 1:
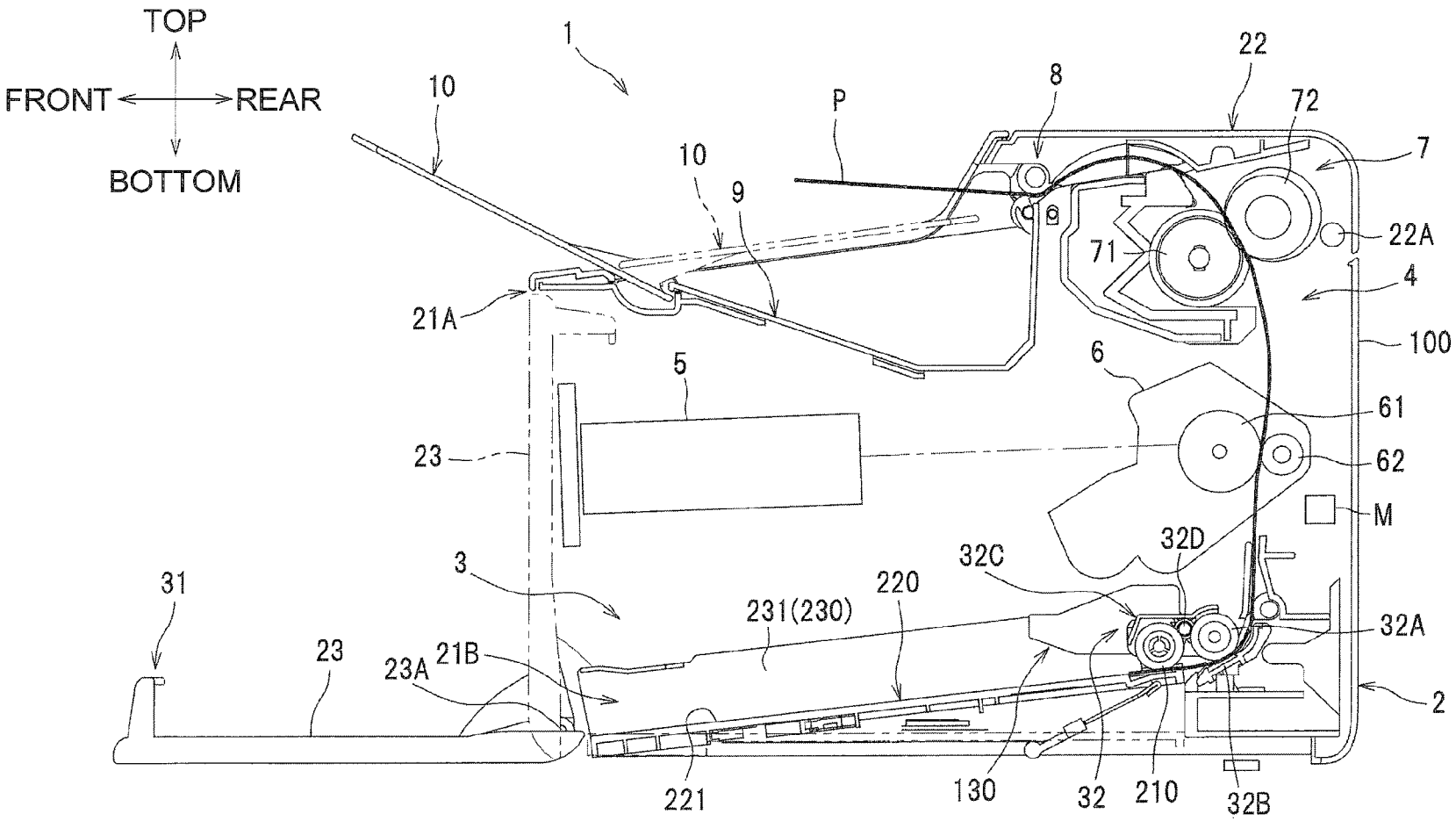
FIG. 1 illustrates a general structure of an illustrative image forming apparatus, e.g. a laser printer, according to an embodiment of the disclosure.

As shown in FIG. 1, the laser printer 1 includes a main body 2, a feeder portion 3 for feeding a sheet P as an example of a recording sheet, and an image forming portion 4 for forming an image on the sheet P.

The main body 2 includes a casing 100, a top cover 22, and a front cover 23. The casing 100 has an opening 21A for attaching and removing a process cartridge 6 in an upper portion, and an insertion opening 21B for inserting sheets P in a front portion.

The top cover 22 is configured to pivot upward about a pivot 22A of the top cover 22 disposed in an upper rear portion of the main body 2. The top cover 22 covers from a rear end portion of the main body 2 to a front end portion thereof, and pivots upward such that an upper side of the main body 2 is released.

The front cover 23 is configured to pivot frontward about a pivot 23A of the front cover 23 disposed in a lower front portion of the main body 2. The front cover 23 covers from a lower end portion of the main body 2 to an upper end portion thereof, and pivots frontward such that a front side of the main body 2 is released. In FIG. 1, the front cover 23 closing the front side of the main body 2 is indicated by a double dotted line, and the front cover 23 releasing the front side of the main body 2 is indicated by a solid line.

In other words, the opening 21A in the upper portion of the casing 100 is opened and closed by the top cover 22, and the insertion opening 21B in the front portion is opened and closed by the front cover 23.

The feeder portion 3 is disposed in a lower portion of the main body 2, and includes a sheet tray 31 for placing a sheet P thereon and a sheet feed mechanism 32 that feeds a sheet P on the sheet tray 31 toward the image forming portion 4.

The sheet tray 31 includes the front cover 23 and a sheet receiving plate 220, as an example of a recording sheet receiving portion, which is disposed in a lower portion of the main body 2. Specifically, when tilted frontward, the front cover 23 constitutes a part of the sheet tray 31. The sheet receiving plate 220 is configured to raise a sheet P received thereon toward a feed roller 210 in time with feeding of a sheet P.

The sheet feed mechanism 32 includes the feed roller 210, a separation roller 32A, and a separation pad 32B. The feed roller 210 is disposed upstream of the separation roller 32A in a sheet conveying direction, and above the rear end of the sheet receiving plate 220. The separation roller 32A is disposed facing the separation pad 32B.

The feed roller 210 and the separation roller 32A constitute one part as a feed roller unit 32C. The feed roller unit 32C includes the feed roller 210, the separation roller 32A, and an idle gear 32D. The idle gear 32D engages a gear (not shown) that rotates together with the feed roller 210 and a gear (not shown) that rotates together with the separation roller 32A. Thus, the feed roller 210 and the separation roller 32A are configured to rotate in an interlocked manner.

In the feeder portion 3, the front cover 23 is tilted down frontward to form the sheet tray 31, and then a sheet P is placed on the sheet tray 31. The feed roller 210 rotates in contact with the sheet P placed on the sheet tray 31, and the sheet P placed on the sheet tray 31 is conveyed to the separation roller 32A, the sheet P is singly separated from the sheet tray 31 by the separation roller 32A and the separation pad 32B and conveyed to the image forming portion 4.

The image forming portion 4 includes a scanner unit 5 as an example of an exposure unit, and a process cartridge 6, and a fixing unit 7.

The scanner unit 5 is disposed in a front portion of the main body 2, and includes a laser emitting portion, a polygon mirror, a lens, and a reflecting mirror, which are not shown. The scanner unit 5 irradiates a surface of a photosensitive drum 61 with a laser beam at high speed scanning.

The process cartridge 6 is located in a central portion at the rear side of the main body 2, and disposed above the sheet feed mechanism 32. The process cartridge 6 is detachable through the opening 21A from the casing 100 upward and frontward. The process cartridge 6 includes a transfer roller 62 that transfers a toner image formed on the photosensitive drum 61 to a sheet P, a charger, a developing roller, a layer thickness regulating blade, and a toner chamber, which are known and not shown.

In the process cartridge 6, the surface of the photosensitive drum 61, which is rotating, is uniformly charged by the charger, and then exposed with the laser beam from the scanner unit 5 by high speed scanning. Thus, a potential in an exposed area lowers, and an electrostatic latent image based on image data is formed on the surface of the photosensitive drum 61.

The developing roller supplies toner in the toner chamber to the electrostatic latent image formed on the photosensitive drum 61, and a toner image is formed on the surface of the photosensitive drum 61. Then, when a sheet P passes between the photosensitive drum 61 and the transfer roller 62, the toner image carried on the surface of the photosensitive drum 61 is transferred onto the sheet P.

The fixing unit 7 is disposed in an upper rear side of the main body 2. The fixing unit 7 is located above the process cartridge 6 and includes a heat roller 71 and a pressure roller 72.

The heat roller 71 is a member that applies heat to a sheet P, and includes a heat source, e.g., a halogen lamp, which is not shown, inside.

The pressure roller 72 is a member that feeds a sheet P by sandwiching the sheet P with the heat roller 71, and is disposed diagonally upward from the rear side of the heat roller 71.

The fixing unit 7 structured as described above is configured to fix toner transferred onto the sheet P thermally while the sheet P passes between the heat roller 71 and the pressure roller 72. The sheet P having the toner thermally fixed thereon is conveyed to an ejection roller 8, which is disposed downstream of the fixing unit 7, and ejected from the ejection roller 8 to an ejection tray 9.

The ejection tray 9 extends diagonally upward from the rear side of the main body 2 to the front side, and is provided as a part of the top cover 22. An extension tray 10 is disposed frontward of the top cover 22 and at a front end portion of the ejection tray 9. The extension tray 10 has a pivot axis in the vicinity of the front end portion of the ejection tray 9, and is configured to pivot between a position facing the extension tray 9, which is indicated by a chain double-dashed line, and a position indicated by a solid line. When no image is formed, the extension tray 10 is folded to the position indicated by the chain double-dashed line to cover the ejection tray 9. When an image is formed, the extension tray 10 is unfolded to the position indicated by the solid line to hold a leading end of a sheet P to be ejected.

The following will describe the casing 100 constituting the main body 2.

Figure 2:
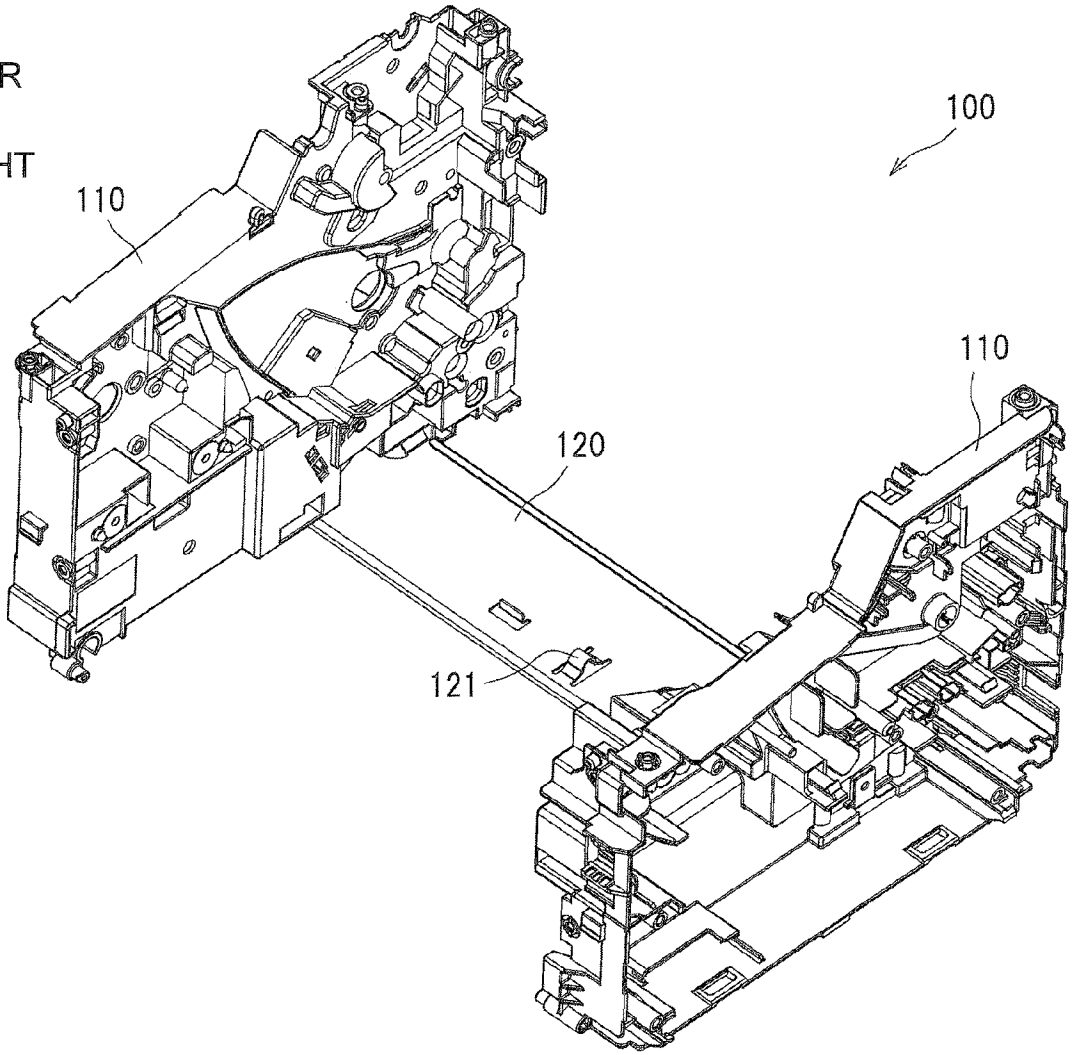
FIG. 2 is a perspective view illustrating a pair of side frames and a bridging member.

As shown in FIG. 2, the casing 100 includes a pair of side frames 110, as an example of a pair of frames, and a bridging member 120.

Figure 4:
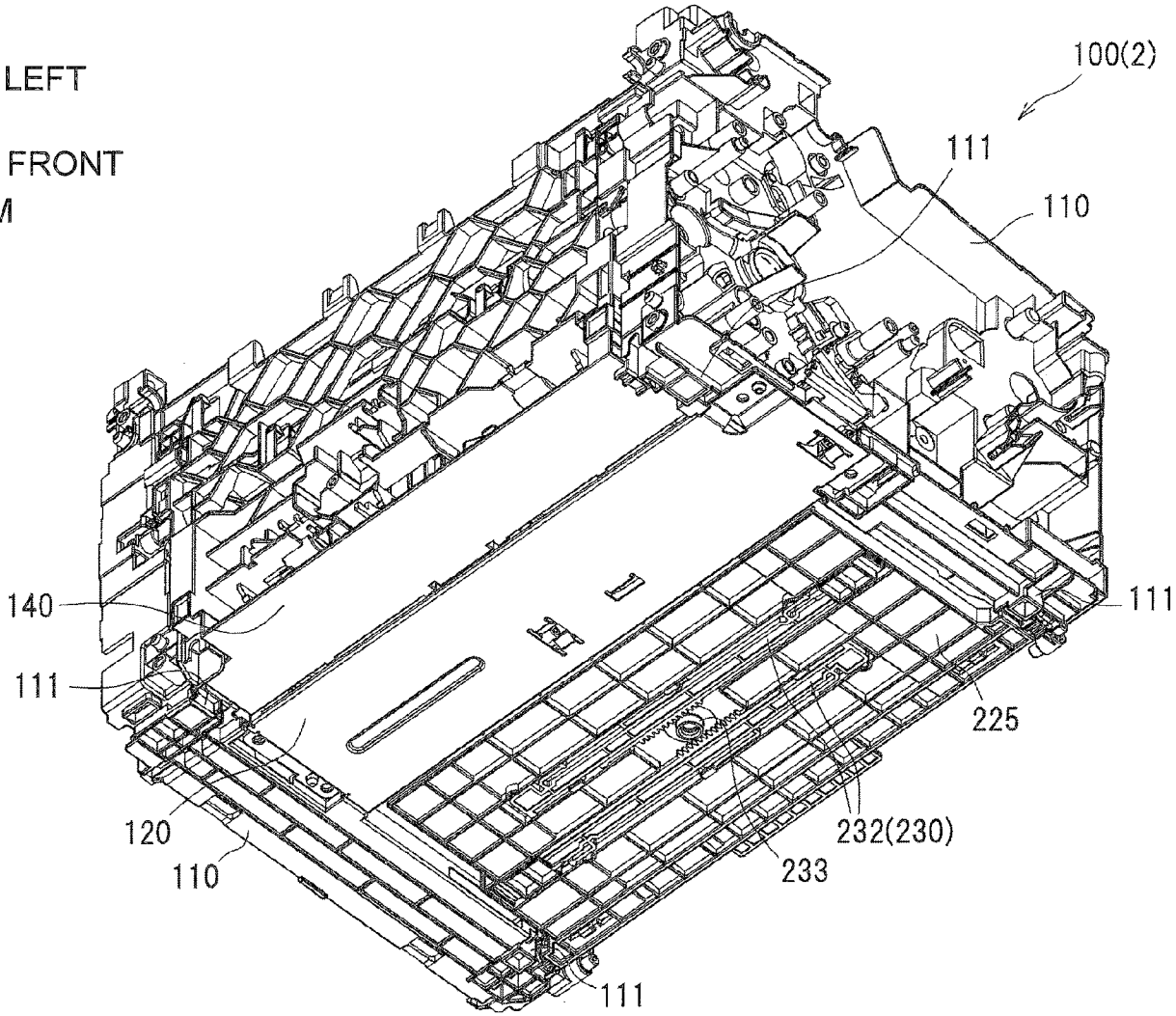
FIG. 4 is a perspective view of the main body and the sheet receiving plate as viewed from below.

The pair of side frames 110 are disposed facing each other such that the image forming portion 4 is sandwiched therebetween in the left-right direction or a width direction. As shown in FIG. 4, a bottom surface of each of the side frames 110 has two legs 111 protruding downward and located at the front and rear portions of the bottom surface respectively.

As shown in FIG. 2, the bridging member 120 is a flat plate-like member formed of sheet metal. The bridging member 120 is fixed to the side frames 110 such that it connects the bottom surfaces of the side frames 110. More specifically, the bridging member 120 connects rear end portions of the side frames 110. Specifically, as shown in FIG. 4, the bridging member 120 has a length smaller than that of the side frames 110 in the front-rear direction, and constitutes some of a rear end portion of the bottom surface of the main body 2. A rear end portion of the bridging member 120 is located frontward of the rear end portions of the side frames 110. A front end portion of the bridging member 120 is located near a central portion of the side frames 110 in the front-rear direction.

Figure 6A:
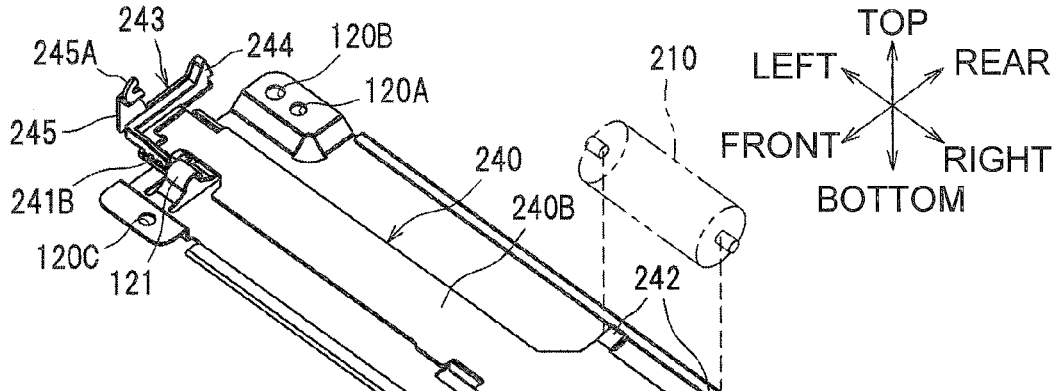
Figure 6B:
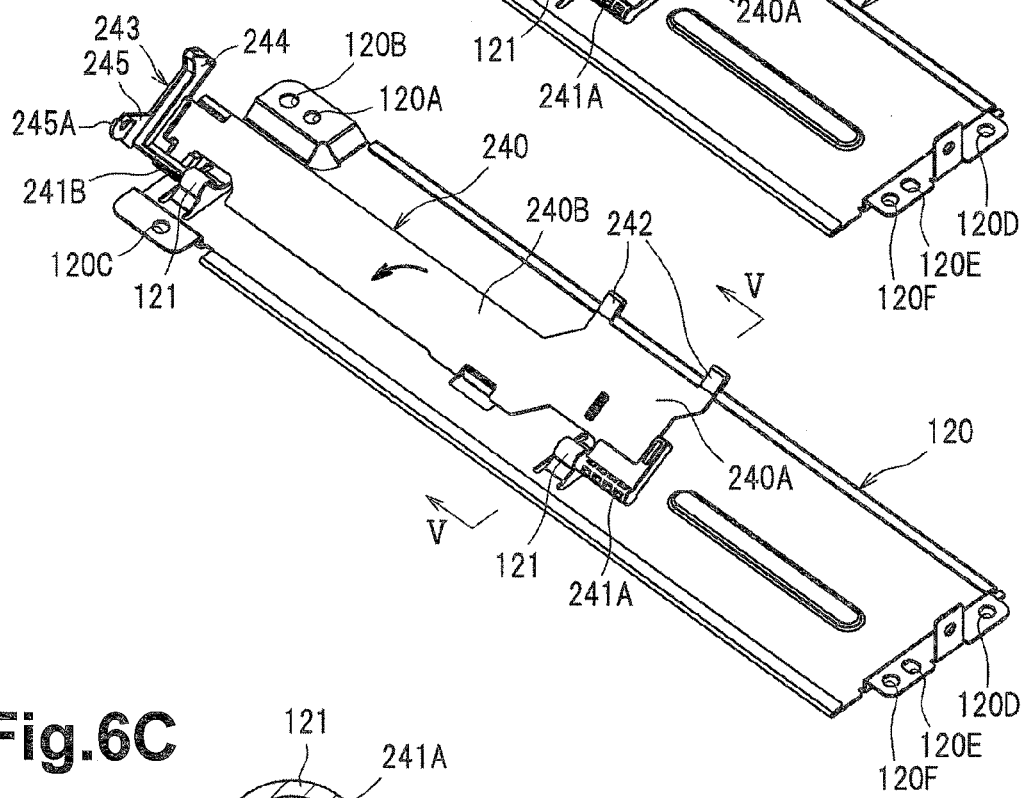

As shown in FIGS. 6A and 6B, the bridging member 120 has holes 120A, 120B, and 120C formed therethrough vertically on the left side. The holes 120A and 120B are provided side by side in the rear end portion of the bridging member 120, and the hole 120C is disposed in the front end portion of the bridging member 120.

The bridging member 120 has holes 120D, 120E, and 120F formed therethrough vertically on the right side. The hole 120D is disposed in the rear end portion of the bridging member 120, and the hole 120F is disposed in the front end portion of the bridging member 120. The hole 120E is disposed closer to the hole 120F than the hole 120D between the hole 120D and the hole 120F.

Two screws, not shown, pass through the respective holes 120A and 120C and are engaged in screw holes, not shown, provided in the left side frame 110 such that the left end portion of the bridging member 120 is fixed to the left side frame 110. Two screws, not shown, pass through the respective holes 120D and 120F and are engaged in screw holes, not shown, provided in the right side frame 110 such that the right end portion of the bridging member 120 is fixed to the right side frame 110.

The holes 120B and 120E are used for positioning. The hole 120B receives an unnumbered boss of the left side frame 110 shown in FIG. 4. The hole 120B is a circular hole having a size substantially equal to that of the boss to be inserted therein. The hole 120E receives an unnumbered boss of the right side frame 110 shown in FIG. 4. The hole 120E is a long hole extending toward a center of the hole 120B, and is intended to engage a boss to be inserted therein and prevent the bridging member 120 from rotating about the boss inserted into the hole 120B.

The bridging member 120 includes support portions 121 for supporting a pivot shaft 241A and a pivot shaft 241B of a lifting member 240. The support portions 121 are disposed in a substantially central portion and a left end portion in the left-right direction. The support portions 121 are formed by cutting and raising a part of the bridging member 120.

Figure 3:
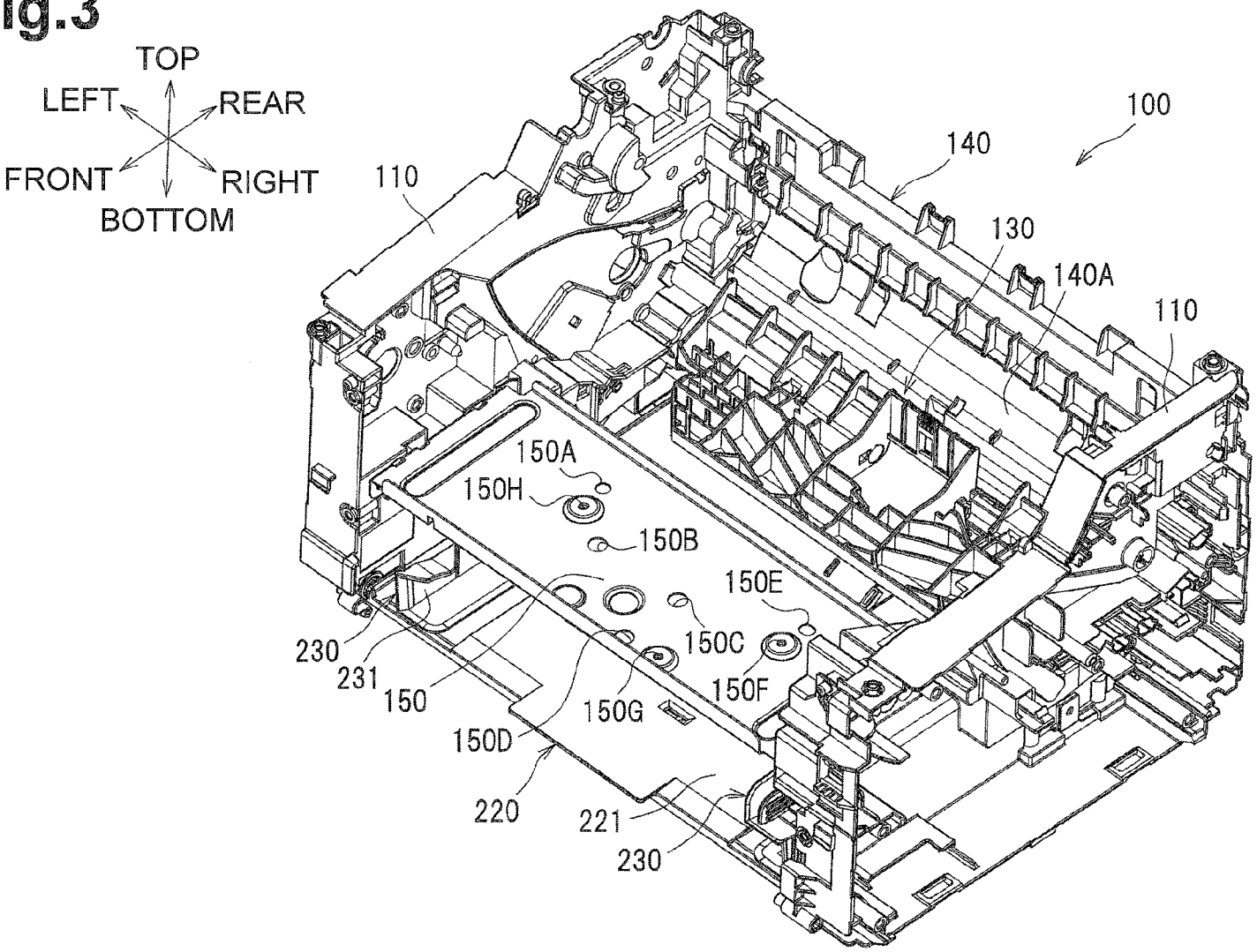
FIG. 3 is a perspective view illustrating a main body and a sheet receiving plate.

As shown in FIG. 3, the casing 100 further includes a holding frame 130, a rear chute 140 as an example of a guiding member, and a scanner unit holding member 150 as an example of an exposure unit holding member, which are disposed above the bridging member 120.

The holding frame 130 is a member that rotatably supports the feed roller 210 which is omitted from FIG. 3. The holding frame 130 is disposed in an upper portion of the bridging member 120 and fixed to the pair of side frames 110 such that it connects the pair of side frames 110.

The rear chute 140 is fixed to the pair of side frames 110 such that it connects the rear end portions of the side frames 110. The rear chute 140 is disposed extending from lower portions of the rear ends of the side frames 110 to upper portions thereof. The rear chute 140 has a guide surface 140A on its inner surface. The guide surface 140A is for guiding a sheet P to be supplied from the feeder portion 3 by the feed roller 210 toward the image forming unit 4.

The scanner unit holding member 150 is configured to hold the scanner unit 5. The scanner unit holding member 150 is made of sheet metal, and configured to fix the scanner unit 5 on an upper surface thereof. The scanner unit holding member 150 is disposed to connect some of front end portions of the side frames 110 or the other end portion. Specifically, the scanner unit holding member 150 is fixed to the side frames 110 above the front portion of the sheet receiving plate 220. More specifically, the front end portion of the scanner unit holding member 150 is located slightly behind the front end portions of the side frames 110, and the rear end portion of the scanner unit holding member 150 is located near a central portion of each of the side frames 110 in the front-rear direction.

The scanner unit holding member 150 has holes 150A, 150B, 150C, 150D, 150E, 150F, 150G, and 150H which are formed therethrough vertically. The holes 150A and 150E are used for positioning, and receive respective unnumbered bosses of the scanner unit 5. The hole 150A is disposed at a position which is slightly left from a central portion of the scanner unit holding member 150 and near the rear end portion of the scanner unit holding member 150. The hole 150A is a circular hole having a size substantially equal to that of a boss to be inserted therein. The hole 150E is a long hole extending toward a center of the hole 150A and receives a boss therein to prevent the scanner unit 5 from rotating about the boss inserted into the hole 150A.

The holes 150B, 150C, and 150D are disposed on a front side of a central portion of the scanner unit holding member 150. The holes 150B, 150C, and 150D receive respective bosses (not shown) of the scanner unit 5. The holes 150B, 150C, and 150D have a size slightly greater than that of the bosses of the scanner unit 5 such as to be capable of receiving the bosses loosely.

The hole 150H is disposed in front of the positioning hole 150A. The hole 150F is disposed in front of the positioning hole 150E. The hole 150G is disposed at a position which is slightly right from the central portion of the scanner unit holding member 150 and near the front end portion of the scanner unit holding member 150. Three screws, not shown, pass through the respective holes 150F, 150G and 150H, and are engaged in screw holes, not shown, in the scanner unit 5 such that the scanner unit 5 is fixed to the scanner unit holding member 150.

The following will describe the detailed structure of the feeder portion 3.

Figure 5:
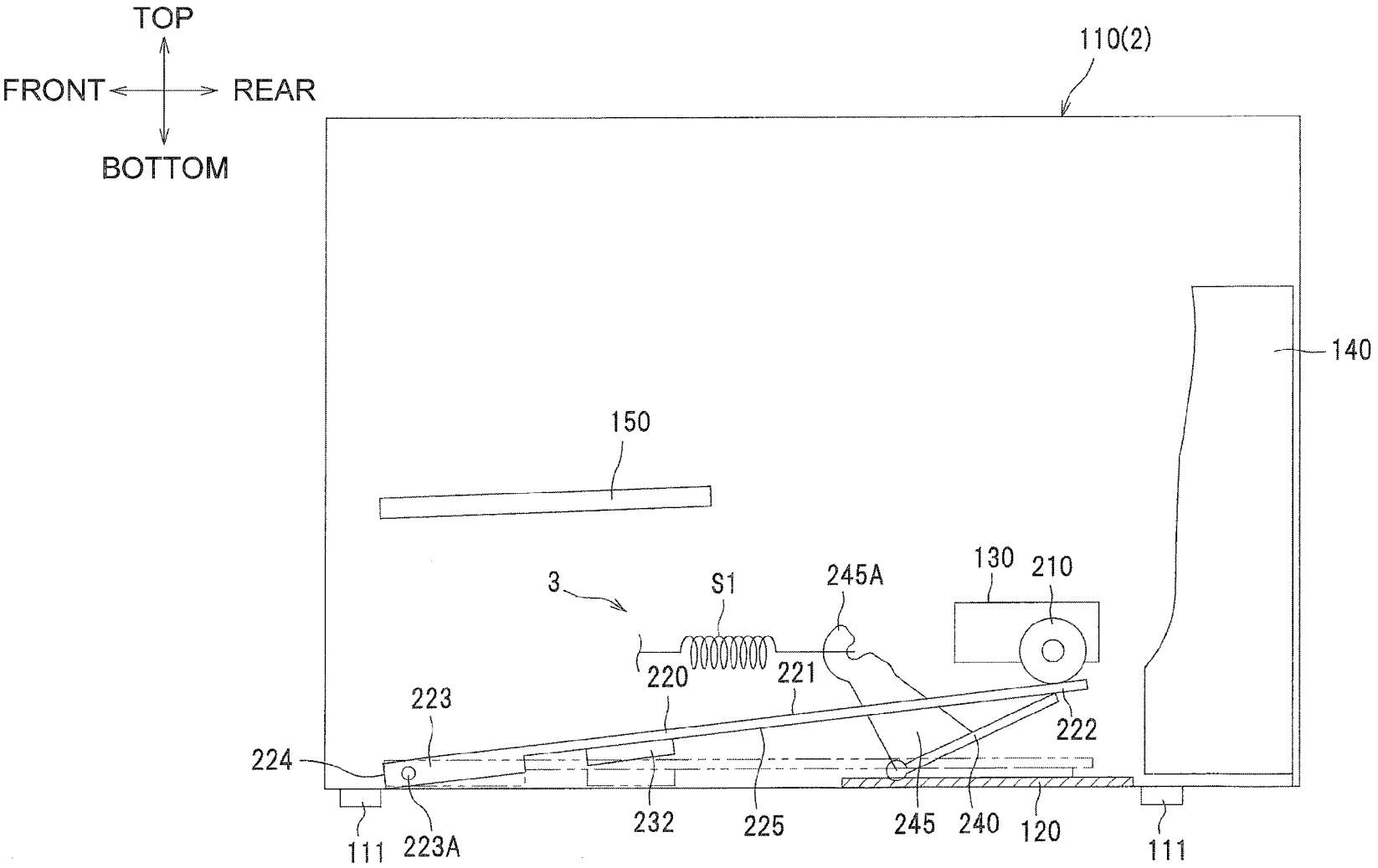
FIG. 5 schematically illustrates the main body and a feeder portion.
Figure 8A:
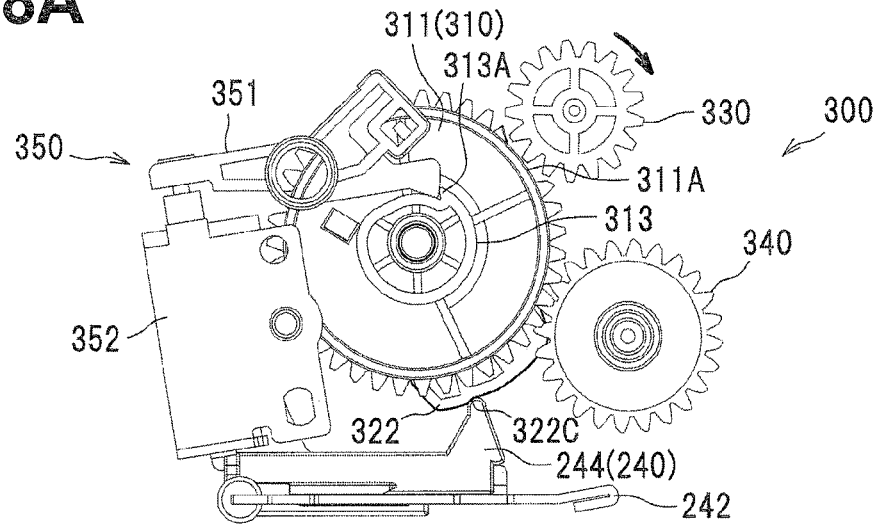
FIGS. 8A and 8B illustrate the feeder portion during standby.

The feeder portion 3 includes the feed roller 210 and the sheet receiving plate 220, which are shown in FIG. 5, a pair of guide members 230, which is shown in FIGS. 1 and 3, for adjusting a position of a sheet P received on the sheet receiving plate 220 in the width direction, a lifting member 240 for moving the sheet receiving plate 220 vertically, a tension spring S1, and a drive mechanism 300 shown in FIG. 8A.

The feed roller 210 is rotatably supported by the holding frame 130 at the rear end portion of the main body 2. The feed roller 210 is configured to receive a driving force from a third gear 340 of the drive mechanism 300 to rotate.

The feed roller 210 is disposed facing a central portion of the sheet receiving plate 220 in the left-right direction.

The sheet receiving plate 220 is a plate-like member on which a sheet P is to be placed. The sheet receiving plate 220 is made of resin which is more lightweight and has a higher degree of flexibility in design compared with sheet metal.

The sheet receiving plate 220 is configured to raise the sheet P received on an upper surface 221, which is a sheet receiving surface, toward the feed roller 210. Specifically, the sheet receiving plate 220 is disposed such that its rear end portion 222, as an example of a first end portion, is located under the feed roller 210, and a rotation shaft 223A located in the vicinity of a front end portion 223, as an example of a second end portion, is rotatably supported by the side frames 110. With this structure, the sheet receiving plate 220 is movable between a nearby position, indicated by a solid line in FIG. 5, where the rear end portion 222 moves toward the feed roller 210 and a remote position, indicated by a double dotted line in FIG. 5, where the rear end portion 222 moves away from the feed roller 210. In the remote position, the sheet P received on the sheet receiving plate 220 does not contact the feed roller 210. However, when the sheet receiving plate 220 moves toward the nearby position, the sheet P contacts the feed roller 210 and the sheet P is conveyed under rotation of the feed roller 210.

The front end portion 223 of the sheet receiving portion 220 is located in the vicinity of the front end portions of the side frames 110 and exposed to a bottom surface of the main body 2. The rear end portion 222 of the sheet receiving portion 220 is located in the vicinity of the rear end portions of the side frames 110, and more specifically in a position facing the feed roller 210.

The sheet receiving plate 220 is disposed such that, when the rear end portion 222 of the sheet receiving plate 220 is located at the highest position or the sheet receiving plate 220 is in the nearby position, an edge 224 of the front end portion 223 overlaps the bridging member 120 as viewed along a surface of the bridging member 120. More specifically, the sheet receiving plate 220 is disposed such that the edge 224 of the front end portion 223 of the sheet receiving plate 220 and the bridging member 120 overlap each other in the horizontal direction.

Thus, this disposition can make efficient use of a space provided in a bottom front portion of the main body 2 by disposing the bridging member 120 only in a part of the rear end portion of the main body 2. More specifically, when the sheet receiving plate 220 is disposed in the nearby position, the edge 224 of the front end portion 223 of the sheet receiving plate 220 is in the lower position. The edge 224 is allowed to enter the space provided in the bottom front portion of the main body 2, thereby the space can be used effectively, and the main body 2 can be made compact in height.

The sheet receiving plate 220 is disposed such that the rear end portion 222 is located above the bridging member 120. In other words, the bridging member 120 is disposed such as to cover the rear portion of the sheet receiving plate 220 on the bottom surface of the main body 2. For example, if the bridging member 120 would be disposed at the rear of the sheet receiving plate 220 with a gap provided between the rear end of the sheet receiving plate 220 and the front end of the bridging member 120, a sheet P received on the sheet receiving plate 220 would pass through the gap. As this embodiment does not provide such a gap, the sheet P received on the sheet receiving plate 220 does not slip off the sheet receiving plate 220.

As shown in FIGS. 1 and 3, the guide members 230 are disposed in the left and right end portions of the sheet receiving plate 220 respectively. The guide members 230 include guide plates 231 and rack gear portions 232 (FIG. 4).

The guide plates 231 extend upward from the left and right ends of the sheet receiving plate 220 and are elongated in the front-rear direction. The guide plates 231 are configured to adjust the position of a sheet P, in a width direction, received on the upper surface 221 of the sheet receiving plate 220, by contacting both ends of the sheet P in the width direction.

The rack gear portions 232 are routed from the lower portions of the guide plates 231, through holes (shown without numerals) formed in the sheet receiving plate 220, to a lower surface 225 of the sheet receiving plate 220 opposite to the upper surface 221, and extend inward in the left-right direction from the left and right ends as shown in FIG. 4. The rack gear portions 232 each have gear teeth formed in a portion where the rack gear portions 232 face each other, and engage a pinion gear 233 located between the rack gear portions 232.

With this structure, as one of the guide members 230 is moved in the width direction in accordance with the size of a sheet P, the other one of the guide members 230 is moved in the width direction in an interlocked manner.

The rack gear portions 232 and the pinion gear 233 are disposed in positions where they do not overlap the bridging member 120 vertically or positions where they overlap the bridging member 120 horizontally. In other words, the bridging member 120 is disposed such that the pair of guide members 230, including the rack gear portions 232 and the pinion gear 233, are exposed to the bottom surface of the main body 2. More specifically, as shown in FIG. 5, the space is provided in the front bottom portion of the main body 2 as described above by disposing the bridging member 120 in only a part of the rear end portion of the main body 2. Thus, the space is effectively used by disposing the rack gear portions 232 and the pinion gear 233 in the space.

Thus, as the bridging member 120, the rack gear portions 232 and the pinion gear 233 do not overlap each other vertically, the need to increase the size of the main body 2 vertically can be obviated.

The lifting member 240 is disposed under the rear end portion 222 of the sheet receiving plate 220 or on an opposite side of the upper surface 221. The lifting member 240 is configured to move between a first position (indicated by a solid line) where the sheet receiving plate 220 is lifted and located in the nearby position and a second position (indicated by a double dotted line) where the sheet receiving plate 220 is located in the remote position.

Specifically, as shown in FIGS. 6A and 6B, the lifting member 240 is a plate-like member that is rotatably supported by the bridging member 120. The lifting member 240 is made of sheet metal and extends from the left end portion of the bridging member 120 to substantially a central portion thereof.

The lifting member 240 includes a connecting portion 240A and a main portion 240B. The connecting portion 240A is disposed in a central portion of the bridging member 120 and has substantially a trapezoidal shape. The main portion 240B extends leftward from the connecting portion 240A or toward the left side frame 110 of the pair of side frames 110. The connecting portion 240A and the main portion 240B are integrally made of sheet metal.

The connecting portion 240A includes the pivot shaft 241A at the front end thereof, and lift portions 242 disposed at the rear end thereof. The lift portions 242 contact the sheet receiving plate 220. The connecting portion 240A connects the pivot shaft 241A and the lift portions 242. The main portion 240B includes, at the left end portion thereof, a pivot shaft 241B and an operation portion 243 that contacts a second cam 322 of the drive mechanism 300. The main portion 240B connects the connecting portion 240A and the operation portion 243. The main portion 240B is narrower than the connecting portion 240A and is substantially uniform in size from an end portion proximate to the connecting portion 240A to an opposite end portion.

The lifting member 240 is configured to pivot about the pivot shafts 241A and 241B such that the lift portions 242 are vertically rotatable.

Figure 6C:
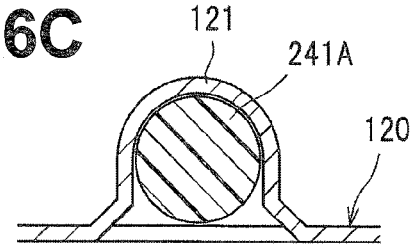

As shown in FIG. 6C, the pivot shafts 241A and 241B have a circular cross section. The pivot shafts 241A and 241B are rotatably supported by the respective support portions 121 of the bridging member 120.

The pivot shafts 241A and 241B are made of resin, and fixed to the connecting portion 240A and the main portion 240B. With this structure, the pivot shafts 241A and 241B are constructed at low costs. It is to be desired that, to obviate the possibility that the lifting member 240 functions as an antenna and become a noise source, the pivot shafts 241A and 241B should be made of resin having electrical conductivity such that the bridging member 120 and the lifting member 240, which are grounded, should be electrically continuous.

Figure 10A:
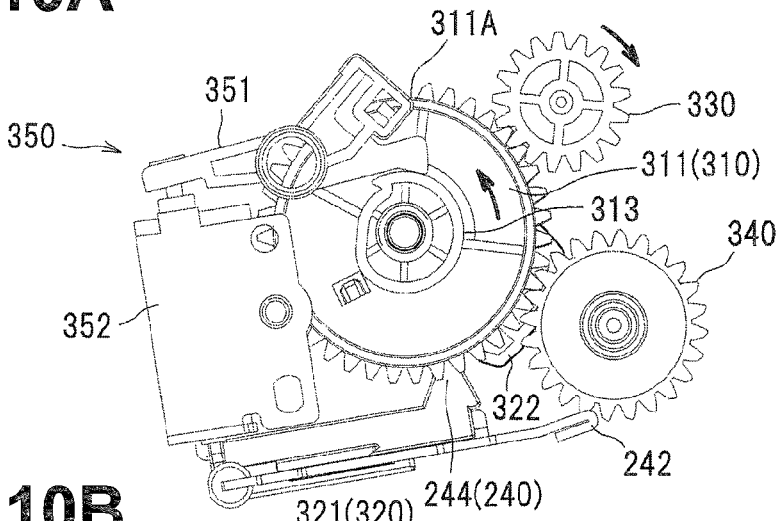
FIGS. 10A and 10B illustrate the feeder portion when the sheet receiving plate starts to move upward.
Figure 10B:
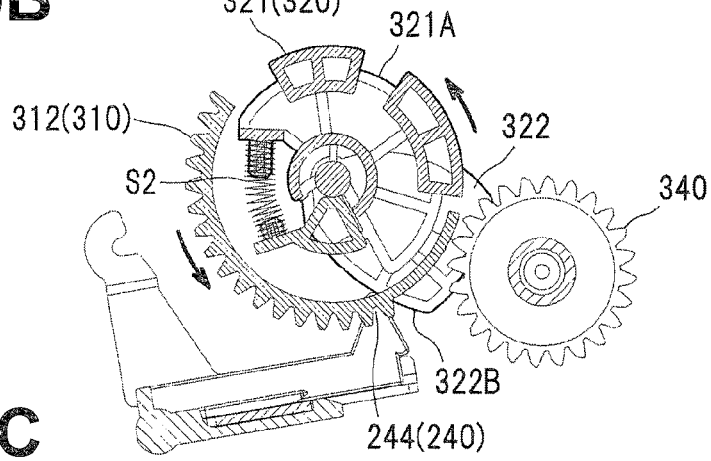
Figure 10C:
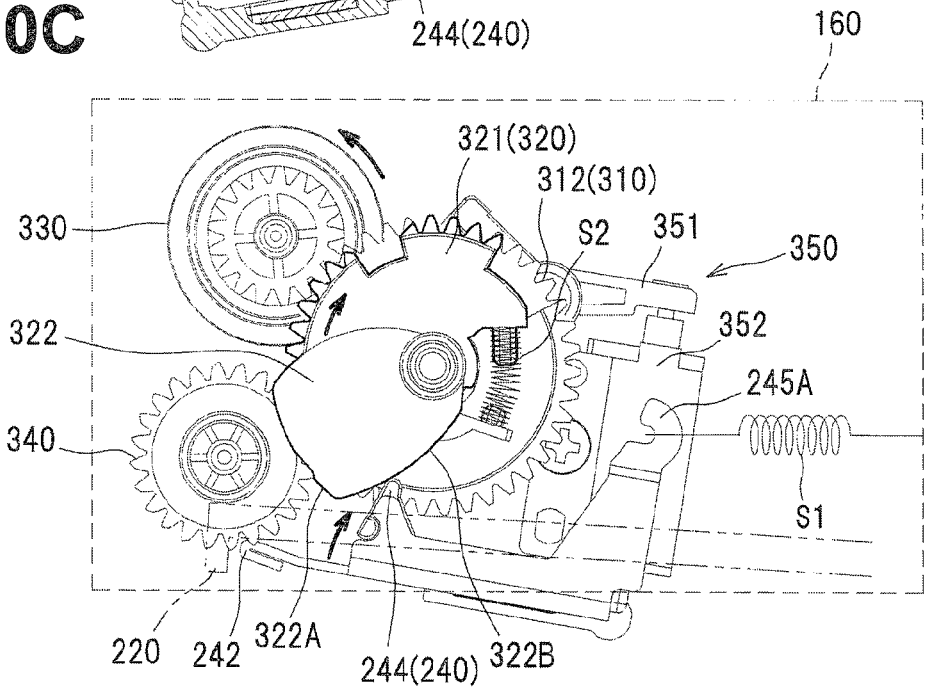
FIG. 10C illustrates the feeder portion viewed from an opposite side thereof shown in FIG. 10A.

There are two lift portions 242 spaced apart from each other in the left-right direction at the rear end of the connecting portion 240A. When in the second position, the lift portions 242 extend diagonally upward to the rear from the connecting portion 240A of the lifting member 240. As shown in FIG. 10C, when the lifting member 240 moves from the second position to the first position, the lift portions 242 contact a central portion in the left-right direction of a lower surface 225 of the sheet receiving plate 220.

The lift portions 242 are disposed in a central portion in the left-right direction of the sheet receiving plate 220 and thus in a position corresponding to the feed roller 210 in the left-right direction as shown in FIG. 6A. More specifically, the lift portions 242 are disposed below the feed roller 210. With this positional relationship, the lift portions 242 are configured to contact the sheet receiving portion 220 in a position overlapping the feed roller 210 in a thickness direction of the sheet receiving plate 220 or vertically.

The operation portion 243 is integrally formed with the pivot shaft 241B. The operation portion 243 extends along a left edge of the main portion 240B in the front-rear direction, and is disposed outside further than the sheet receiving plate 220 in the width direction of a sheet P or in the left-right direction.

The operation portion 243 includes, at a rear end portion thereof, a contact portion 244 having a shape of substantially a triangle that protrudes upward as viewed from a side. The operation portion 243 is made of resin. The operation portion 243 includes, at a front end thereof, an arm portion 245 extending upward, and the arm portion 245 includes, at a distal end thereof, a hook portion 245A.

Figure 8B:
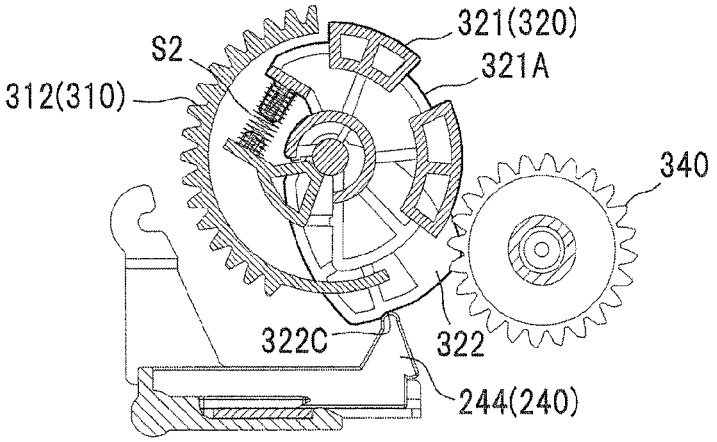
Figure 8C:
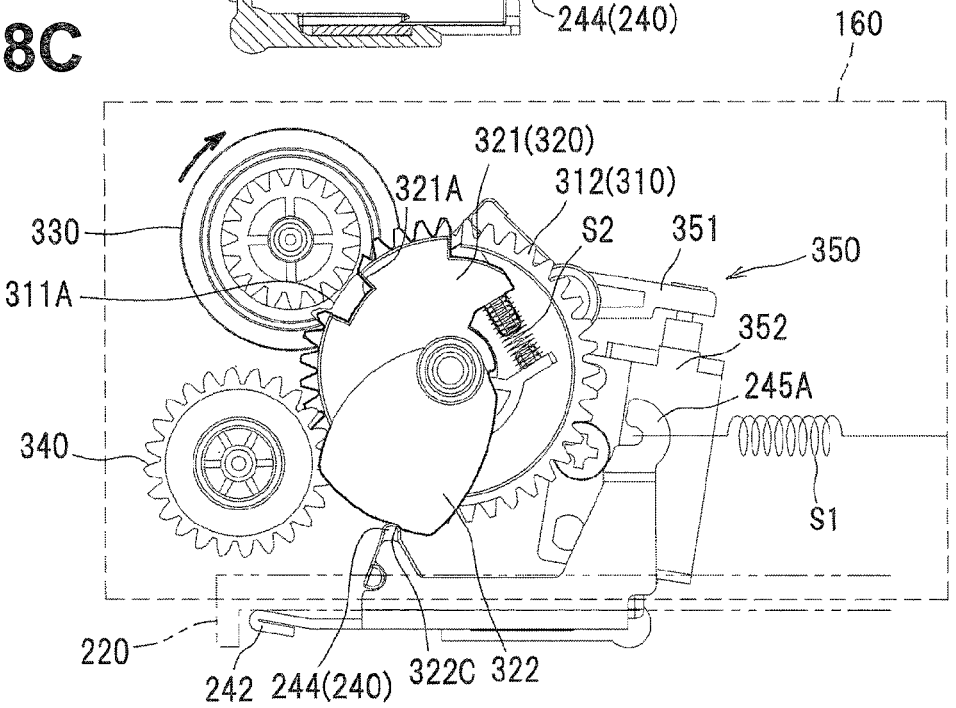
FIG. 8C illustrates the feeder portion viewed from an opposite side thereof shown in FIG. 8A.

As shown in FIG. 8C, the tension spring S1 is engaged at the hook portion 245A of the lifting member 240 at one end portion, and supported by a gear support member 160 at the other end portion. The tension spring S1 is elongated in the front-rear direction along the upper surface 221 of the sheet receiving plate 220 located in the remote position.

The tension spring S1 pulls the hook portion 245A frontward. In other words, the tension spring S1 urges the lifting member 240 from the second position shown in FIG. 6A toward the first position shown in FIG. 6B.

The drive mechanism 300 is a mechanism for controlling movement of the lifting member 240 between the first position and the second position and rotation of the feed roller 210. Specifically, the drive mechanism 300 is configured to move the lifting member 240 from the second position to the first position in time with supplying of a sheet P, rotate the feed roller 210, and then return the lifting member 240 to the second position. The drive mechanism 300 is disposed in the left end portion of the lifting member 240, that is, in an end portion of the main portion 240B opposite to the connecting portion 240A.

The drive mechanism 300 includes a first gear 310 shown in FIG. 7A, a second gear 320 shown in FIG. 7C, and a drive gear 330, a third gear 340 and a latch mechanism 350, which are shown in FIG. 8A.

As shown in FIG. 8C, the first gear 310, the second gear 320, the drive gear 330, and the third gear 340 are rotatably supported by the gear support member 160 disposed within the main body 2.

As shown in FIGS. 7A and 7B, the first gear 310 includes a drive gear portion 311, a transmission gear portion 312, a first cam 313, a first spring support portion 314, and first stopper portions 316.

The drive gear portion 311 is a circular gear having gear teeth on a peripheral surface thereof except for a missing teeth portion 311A. The drive gear portion 311 is configured to rotate by engagement of the drive gear 330. During standby where no sheets are supplied, or in conditions shown in FIGS. 8A to 8C, the missing teeth portion 311A is disposed in a position facing the drive gear 330.

The transmission gear portion 312 is substantially a semi-circular gear having gear teeth on about two-thirds of a peripheral surface thereof. The transmission gear portion 312 is configured to rotate in engagement with the third gear 340 to cause the third gear 340 to rotate. The transmission gear portion 312 is disposed such that the gear teeth thereof do not face the third gear 340 during standby and faces the third gear 340 after the lifting member 240 is located in the first position. The gear teeth of the transmission gear portion 312 are provided such as to rotate the third gear 340 only by the amount required for the feed roller 210 to pick up a sheet P.

The first cam 313 is of substantially a tubular shape, and has an engaging pawl 313A radially protruding from a peripheral surface thereof. The engaging pawl 313A is intended to prevent the first gear 310 from rotating during standby by engagement of a distal end of a latch arm 351.

The drive gear portion 311, the transmission gear portion 312, and the first cam 313 are integrally formed with each other such as to rotate coaxially. Specifically, the first cam 313, the drive gear portion 311, and the transmission gear portion 312 are arranged in this order in an axial direction such that a center of a through hole 315 formed in the first gear 310 is a center of rotation.

The first spring support portion 314 is disposed on a side of the first gear 310 opposite the first cam 313. The first spring support portion 314 has a first support surface 314A extending radially from the through hole 315 and a first support protrusion 314B protruding from the first support surface 314A.

The first stopper portions 316 are walls radially extending from the through hole 315, and located at two positions shifted circumferentially.

As shown in FIGS. 7C and 7D, the second gear 320 includes a gear portion 321, a second cam 322, a second spring support portion 323, and second stopper portions 325.

The gear portion 321 is substantially semi-circularly shaped, and has gear teeth on a circumferential surface thereof. Specifically, the circumferential surface of the gear portion 321 has a missing gear portion 321A having a circumferential length equal to that of the missing teeth portion 311A of the drive gear portion 311 of the first gear 310, and gear teeth disposed in such a manner as to sandwich the missing gear portion 321A. The gear teeth of the gear portion 321 are provided such that they are in phase with those of the drive gear portion 311 of the first gear 310. The gear portion 321 is disposed such that the missing teeth portion 321A overlaps the missing teeth portion 311A of the first gear 310 during standby.

The second cam 322 is a cam that rotates coaxially with a rotation axis of the gear portion 321, and is disposed in a position where the second cam 322 is capable of contacting a contact portion 244 of the lifting member 240 in the axial direction. The second cam 322 has a circumferential surface comprised of a first surface 322A, a second surface 322B, and a recessed portion 322C.

Specifically, the first surface 322A is disposed in a position away from a center of rotation of the second cam 322 such as to position the lifting member 240 in the second position against an urging force of the tension spring S1 when the first surface 322A faces the contact portion 244 of the lifting member 240.

The second surface 322B is a surface having a shorter distance from the center of rotation than that of the first surface 322A, and is configured to allow the lifting member 240 to move from the second position to the first position by the urging force of the tension spring S1 when the second surface 322B faces the contact portion 244 of the lifting member 240.

The recessed portion 322C is provided on the first surface 322A. The recessed portion 322C is shaped such that, when the recessed portion 322C faces the contact portion 244 of the lifting member 240, a force with which the contacting portion 244 presses the recessed portion 322C (a cam surface) is directed toward the center of rotation of the second cam 322.

The second cam 322 structured as described above is disposed such that the recessed portion 322C faces the contact portion 244 of the lifting member 240 during standby.

The gear portion 321 and the second cam 322 are integrally formed such that they rotate together about a shaft portion 324 of the second gear 320 as a rotation shaft.

The second spring support portion 323 is disposed on an end surface of the gear portion 321 extending radially. The second spring support portion 323 has a second support surface 323A extending radially and a second support protrusion 323B protruding from the second support surface 323A.

The second stopper portions 325 are protrusions protruding in a circumferential direction from walls extending radially from the shaft portion 324. The second stopper portions 325 are located at two positions shifted circumferentially in such a manner as to sandwich the first stopper portions 316 of the first gear 310 when the second gear 320 is attached to the first gear 310.

As shown in FIGS. 7E and 7F, the first gear 310 and the second gear 320 structured as described above are combined into one component by inserting the shaft portion 324 of the second gear 320 into the through hole 315 of the first gear 310, and the shaft portion 324 is rotatably supported by the gear support member 160. One of the first gear 310 and the second gear 320 is rotatable relative to the other one. One of the first gear 310 and the second gear 320 is prevented from rotating relative to the other one by engagement of the first stopper portions 316 of the first gear 310 with the second stopper portions 325 of the second gear 320. When the first stopper portions 316 engage the second stopper portions 320, the gear teeth of the drive gear portion 311 of the first gear 310 are in phase with the gear teeth of the gear portion 321 of the second gear 320.

In a state where the second gear 320 is assembled to the first gear 310, an end of the second support protrusion 323B faces an end of the first support protrusion 314B, and a compression spring S2 is interposed between the first spring support portion 314 and the second spring stopper portion 323.

As shown in FIG. 8A, the drive gear 330 is a gear that rotates upon a driving force inputted from a drive source M (FIG. 1) disposed within the main body 2. The drive gear 330 is disposed in such a position that the drive gear 330 is engageable with the drive gear portion 311 of the first gear 310 and the second gear 320 and does not engage the transmission gear portion 312 of the first gear 310.

The third gear 340 is a gear that transmits a rotational driving force to the feed roller 210. The third gear 340 is disposed in such a position that the third gear 340 is engageable with the transmission gear portion 312 of the first gear 310 and does not engage the drive gear portion 311 of the first gear 310 and the second gear 320.

The latch mechanism 350 includes the latch arm 351 that is pivotable and a solenoid 352 that presses and pulls a proximal end portion of the latch arm 351. The latch arm 351 is disposed in a position where a distal end thereof contacts the circumferential surface of the first cam 313 of the first gear 310.

The following will describe the operation of the feeder portion 3 structured as described above.

During standby shown in FIGS. 8A to 8C, the recessed portion 322C on the first surface 322A of the second cam 322 faces the contact portion 244 of the lifting member 240. Thus, the second cam 322 holds the lifting member 240 in the second position against the urging force of the tension spring S1.

During standby, the second gear 320 is prevented from rotating by engagement of the recessed portion 322C of the second cam 322 with the contact portion 244 of the lifting member 240. The first gear 310 is prevented from rotating in such a position that the compression spring S2 is compressed by engagement of the latch arm 351 with the engaging pawl 313A.

Figure 9A:
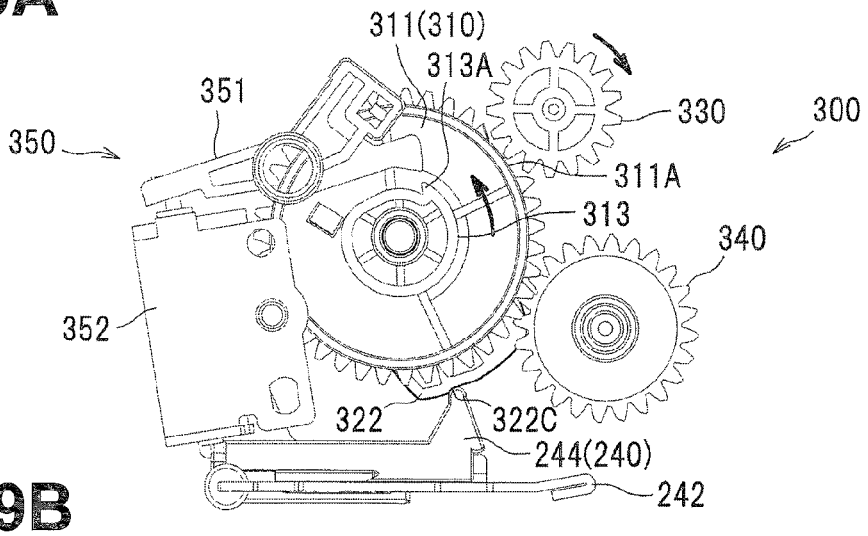
FIGS. 9A and 9B illustrate the feeder portion during operation of a solenoid.
Figure 9B:
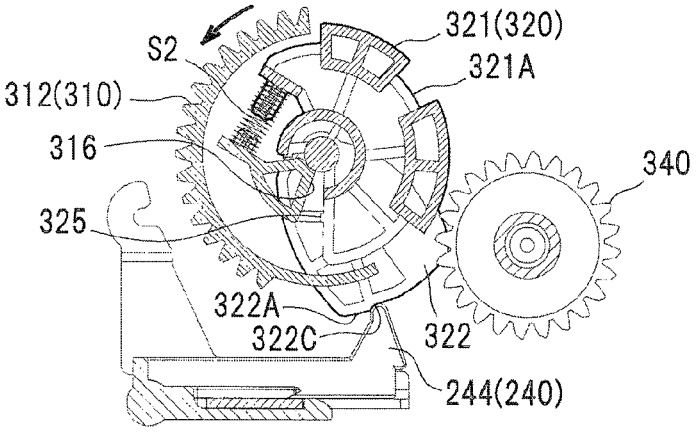
Figure 9C:
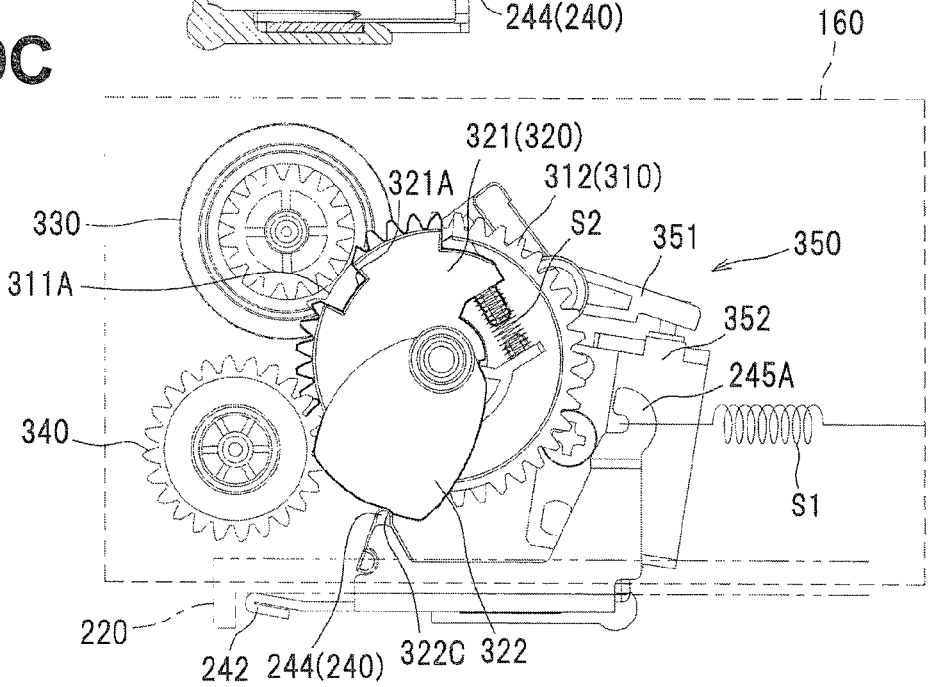
FIG. 9C illustrates the feeder portion viewed from an opposite side thereof shown in FIG. 9A.

As shown in FIG. 9A, when it comes time to supply a sheet P, the solenoid 352 is actuated from a standby status, and the latch arm 351 is disengaged from the engaging pawl 313A of the first gear 310. Then, as shown in FIGS. 9A to 9C, the first gear 310 is caused to rotate counterclockwise in FIG. 9A by the urging force of the compression spring S2, and the gear teeth of the drive gear portion 311 of the first gear 310 engage the drive gear 330 rotating. Thus, the first gear 310 is driven by the drive gear 330 and starts to rotate.

When the drive gear portion 311 of the first gear 310 rotates, the first stopper portion 316 disposed on a downstream side in a rotation direction of the first gear 310 collides with the second stopper portion 325 of the second gear 320 facing the first gear 310 and presses the second gear 320. Thus, as shown in FIGS. 10A to 10C, the second gear 320 starts to rotate. When the second gear 320 rotates, a surface of the second cam 322 facing the contact portion 244 of the lifting member 240 changes from the first surface 322A to the second surface 322B. Thus, the lifting member 240 starts to move upward from the second position toward the first position along the second surface 322B of the second cam 322 by the urging force of the tension spring S1. When the lifting member 240 moves from the second position to the first position, the lift portions 242 of the lifting member 240 lift the sheet receiving plate 220 from below. Thus, the rear end portion 222 of the sheet receiving plate 220 starts to move from the remote position to the nearby position.

Figure 11A:
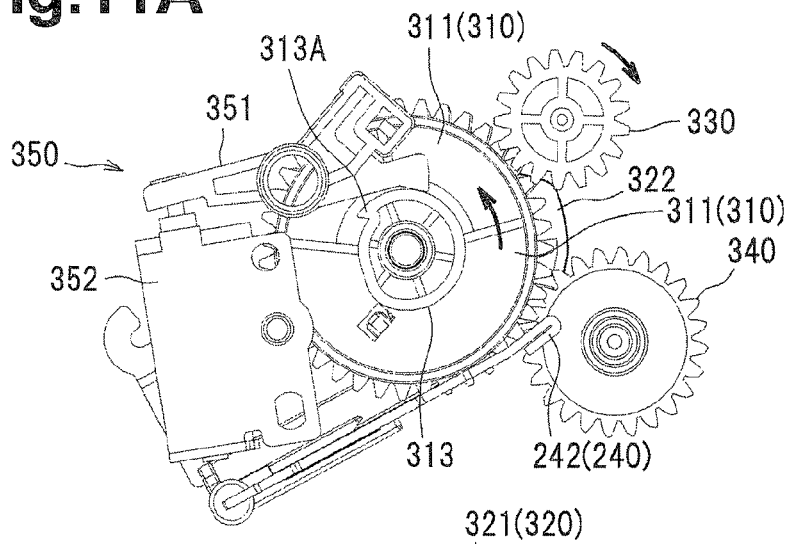
FIGS. 11A and 11B illustrate the feeder portion when a feed roller starts to rotate.
Figure 11B:
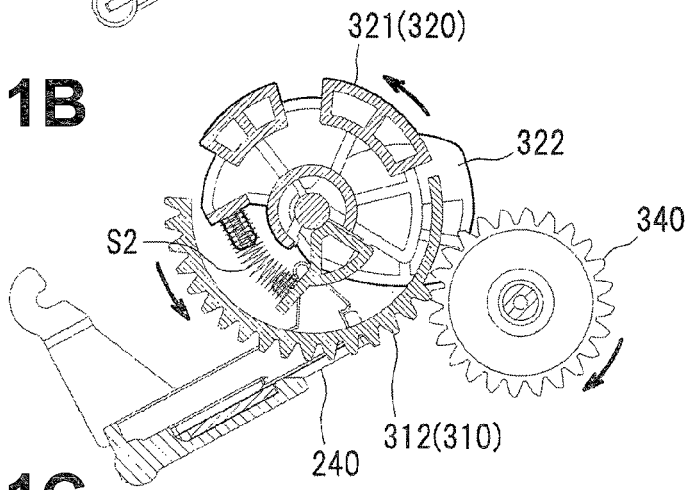
Figure 11C:
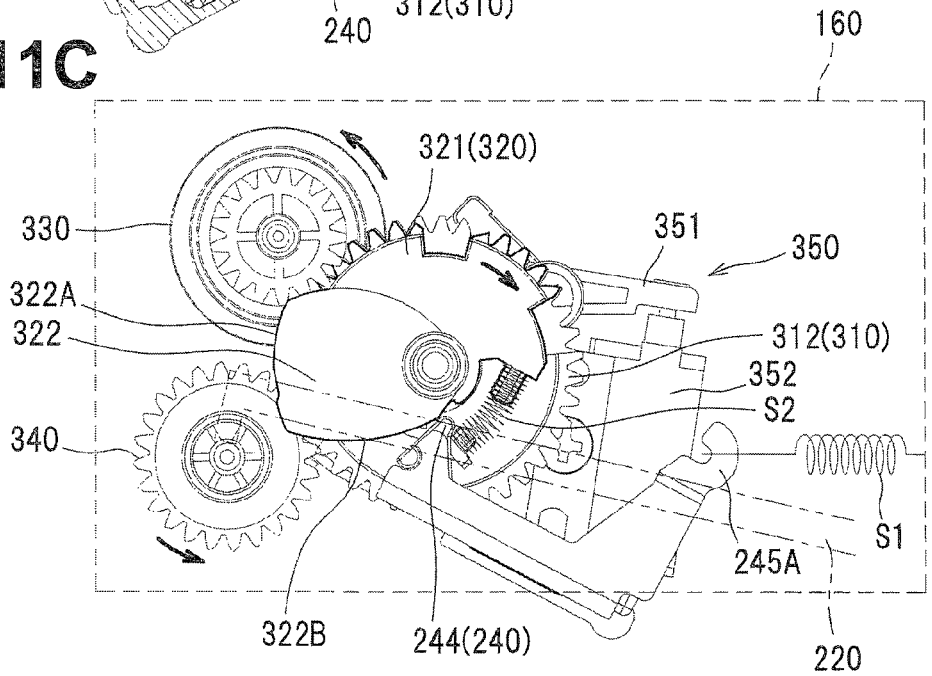
FIG. 11C illustrates the feeder portion viewed from an opposite side thereof shown in FIG. 11A.

When the first gear 310 and the second gear 320 rotate, as shown in FIGS. 11A to 11C, the sheet receiving plate 220 is located in the nearby position and the gear teeth of the transmission gear portion 312 of the first gear 310 engage the third gear 340. As the third gear 340 starts to rotate, the feed roller 210 also rotates. Thus, the sheet P received on the sheet receiving plate 220 is supplied by the feed roller 210.

After the sheet P is supplied, the gear teeth of the transmission gear portion 312 of the first gear 310 are disengaged from the third gear 340, and the feed roller 210 stops.

When the first gear 310 and the second gear 320 further rotate, the surface of the second cam 322 facing the contact portion 244 of the lifting member 240 changes from the second surface 322B to the first surface 322A, and thus the lifting member 240 is pressed downward from the first position to the second position. This also causes the sheet receiving plate 220 to move from the nearby position to the remote position.

Then, as shown in FIG. 8A, the distal end of the latch arm 351 engages the engaging pawl 313A of the first gear 310, and the first gear 310 stops rotating. The recessed portion 322C of the second cam 322 engages the contact portion 244 of the lifting member 240, and the second gear 320 stops. In other words, the second cam 322 makes one rotation in time with supplying of a sheet P, causing the lifting member 240 to move from the second position to the first position and then to the second position.

According to the embodiment, the following effects can be obtained.

The lifting member 240 is configured to pivot while contacting the sheet receiving plate 220 such that the sheet receiving plate 220 moves the feed roller 210 vertically. Thus, the lifting member 240 can be made of a thin plate as described in the embodiment. This structure can obviate the need to increase the physical size of the main body 2 compared with a structure to lift the sheet receiving plate 220 by a spring disposed under the she receiving plate 220. In addition, as the bridging member 120 includes the pivot shaft 241A about which the lifting member 240 pivots, the need to increase the physical size of the main body 2 can be further obviated.

The lift portions 242 of the lifting member 240 are configured to contact the central portion of the sheet receiving plate 220 in the width direction. With this structure, the sheet receiving portion 220 is resistant to deformation, for example, compared with a structure where the lift portions contact an end portion of the sheet receiving plate 220 in the width direction. Especially, this structure is effective for the sheet receiving plate 220 made of resin like this embodiment.

As the lift portions 242 press the sheet receiving portion 220 upward at a position corresponding to the feed roller 210, a sheet P on the sheet receiving plate 220 can be brought closer to the feed roller 210 reliably. This structure stabilizes sheet supply operation.

As the connecting portion 240A and the main portion 240B of the lifting member 240 are integrally formed of sheet metal, the thickness of the lifting member 240 can be controlled and the stiffness thereof can be ensured.

The drive mechanism 300 to drive the lifting member 240 is disposed only in one end, or the left end, of the lifting member 240 in the width direction. The structure of the drive mechanism 300 can be simplified and thus the need to increase the physical size of the main body 2 can be obviated compared with a structure where the drive mechanism is provided on both ends in the width direction.

The bridging member 120 partly connects the pair of side frames 110 in the rear end portion of the main body 2 where the feed roller 210 is disposed. This structure can hold down the manufacturing cost compared with a case where the bridging member 120 is provided to entirely connect the pair of side frames 110. In addition, as the bridging member 120 is disposed on a side where the feed roller 210 is provided, the strength of the side frames 110 on the side where the feed roller 210 is provided is stabilized, the feed roller 210 and its surrounding are resistant to distortion, and the accuracy in sheet supply can be improved.

In the front end portion of the main body 2, the scanner unit holding member 150 is disposed to connect the pair of side frames 110. Thus, this structure also ensures the strength of the main body 2 on a side where the bridging member 120 is not disposed. In addition, while the bridging member 120 and the scanner unit holding member 150 can be made as small as possible, the entire strength of the main body 2 can be ensured.

In the rear end portion of the main body 2, the rear chute 140 is disposed to connect the rear end portions of the pair of side frames 110. Thus, the strength of the rear end portion of the main body 2 can be further improved.

As the bridging member 120 is made of sheet metal, it can be made thinner compared with a case where it is made of resin. Thus, the need to increase the physical size of the main body 2 can be obviated.

The above embodiment shows, but is not limited to, that the main portion 240B of the lifting member 240 is substantially uniform in size from the end portion proximate to the connecting portion 240A to the opposite end portion. For example, to ensure the stiffness against the distortion of the lifting member, the main portion may be created thicker in the end portion proximate to the connecting portion.

Figure 12A:
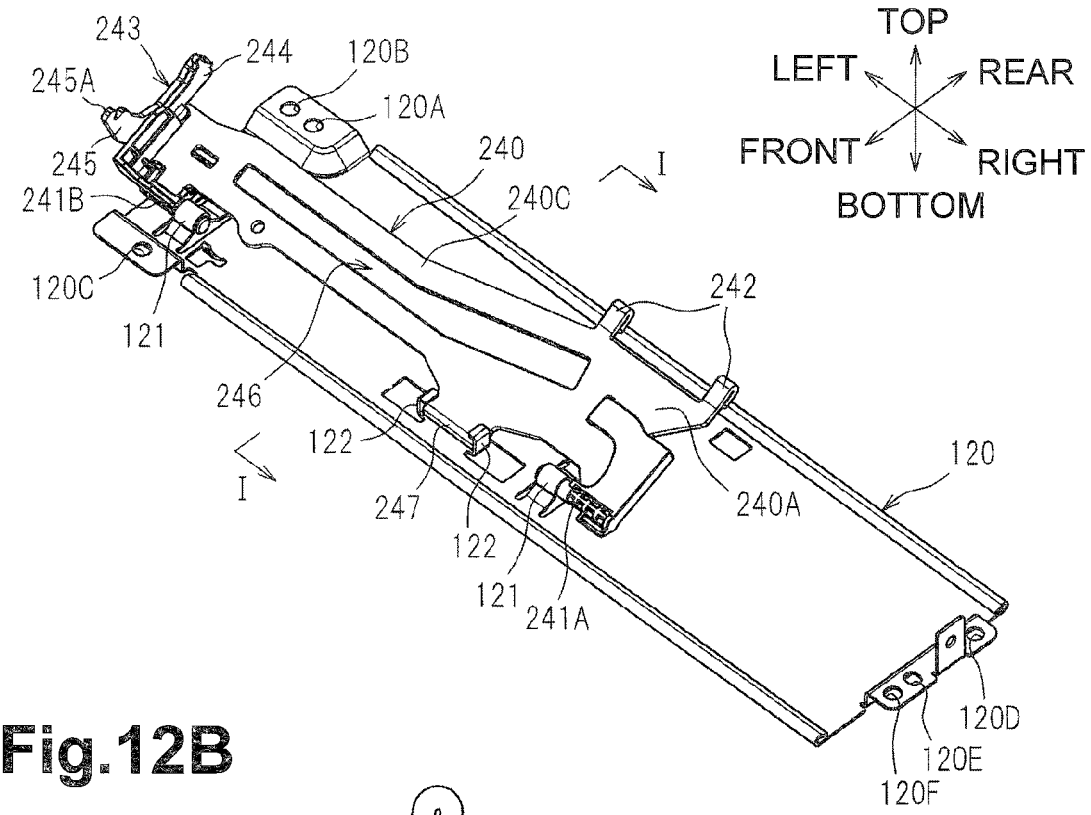
FIG. 12A is a perspective view illustrating a bridging member and a lifting member according to a modification of the disclosure.

Specifically, as shown in FIG. 12A, the lifting member 240 includes the connecting portion 240A disposed in a central portion of the bridging member 120, and a main portion 240C extending leftward from the connecting portion 240A and integrally formed with the connecting portion 240A.

The main portion 240C is narrower in an end portion thereof opposite to the connecting portion 240A than in an end portion thereof proximate to the connecting portion 240A. More specifically, the end portion of the main portion 240C proximate to the connecting portion 240A is sized substantially equal to the connecting portion 240A. The main portion 240C is gradually narrower as it is farther from the connecting portion 240A toward a central portion of the main portion 240C. The main portion 240C is substantially uniform in size in a range from the central portion thereof to the end portion opposite to the connecting portion 240A.

The main portion 240C is made thick in a portion thereof subject to distortion and made thin in a portion thereof resistant to distortion. With this structure, the stiffness of the main portion 240C is ensured and weight of the main portion 240C is reduced.

Figure 12B:
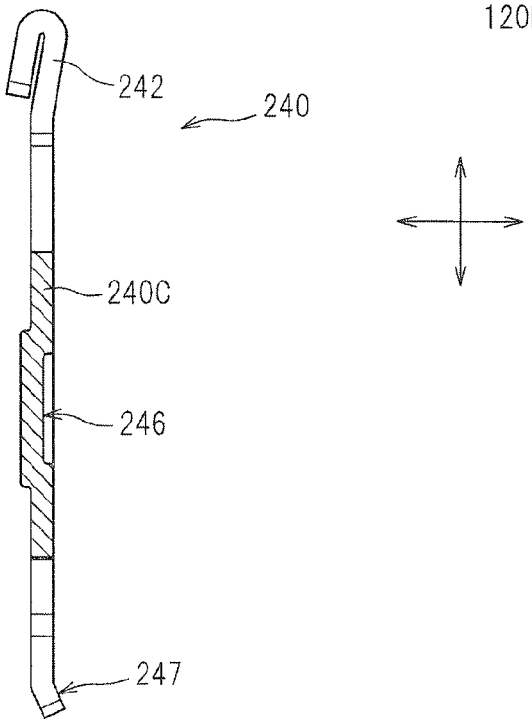
FIG. 12B is a sectional view taken along a line I-I of FIG. 12A.

To reduce distortion, the main portion 240C includes a reinforcing portion 246 extending along a pivot shaft of the lifting member 240. As shown in FIG. 12B, for example, the reinforcing portion 246 is a recessed portion made by a drawing process such as to protrude downward or in a thickness direction of the lifting member 240.

As shown in FIG. 12A, the lifting member 240 has, in the front end portion, a rotation restricting portion 247 that is configured to engage position restricting portions 122 disposed in the bridging portion 120.

Figure 13:
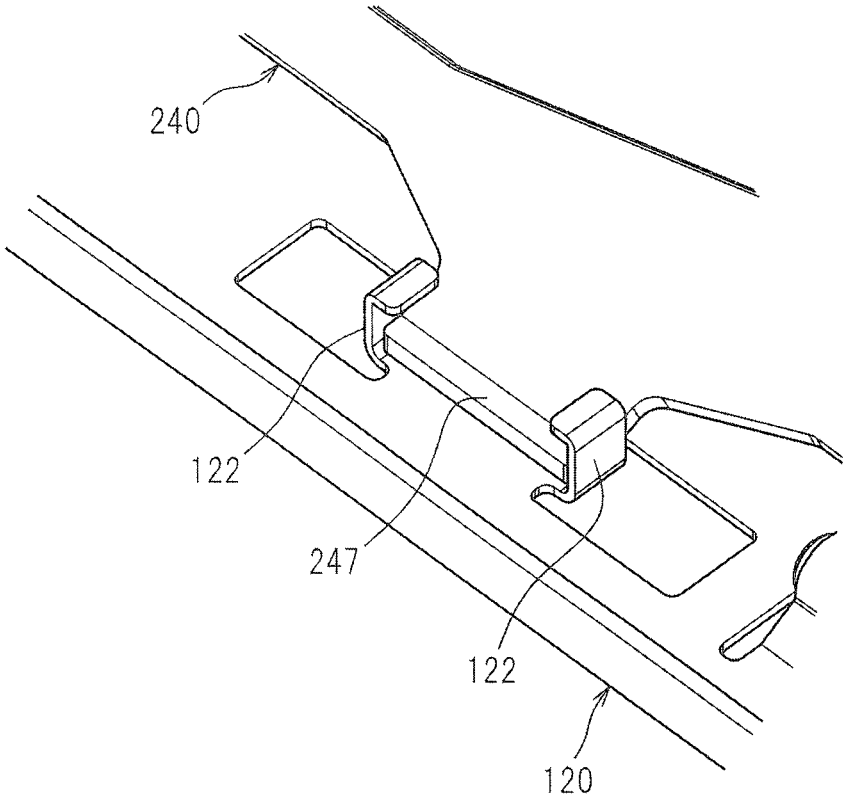
FIG. 13 is a perspective view illustrating a rotation restricting portion of the lifting member according to the modification of the disclosure.
Figure 14A:
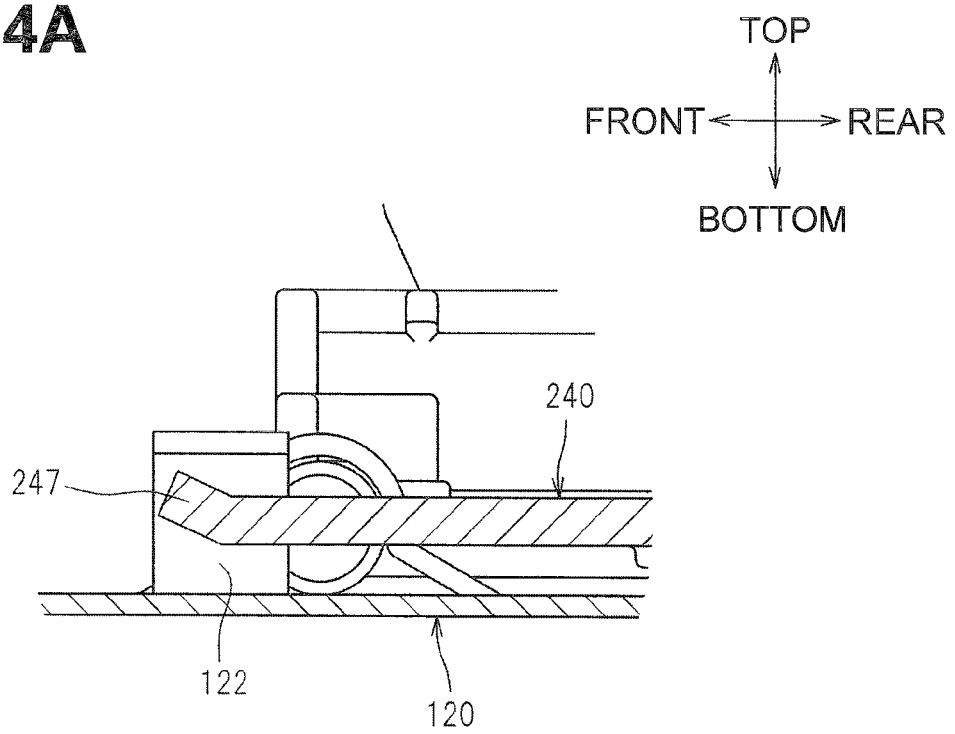
FIG. 14A is a sectional view of the rotation restricting portion when located in a second position.

As shown in FIGS. 13 and 14A, the rotation restricting portion 247 protrudes frontward from a part of the front end of the main portion 240C, and is bent upward at its end.

The position restricting portions 122 are formed by cutting and raising a part of the bridging member 120, and each have a hook shape to engage the rotation restricting portion 247. Specifically, the position restricting portions 122 protrude upward from an upper surface of the bridging member 120 in both end portions of the rotation restricting portion 247 in the left-right direction, and are bent inwardly in the left-right direction above the rotation restricting portion 247.

With this structure, the position restricting portions 122 sandwich the rotation restricting portion 247 therebetween in the left-right direction, and thus restrict the movement of the rotation restricting portion 247 in the left-right direction is restricted. As the movement of the rotation restricting portion 247 in the left-right direction is restricted, the movement of the lifting member 240 in the left-right direction is restricted. This prevents the lifting member 240 from coming off from the bridging member 240.

Figure 14B:
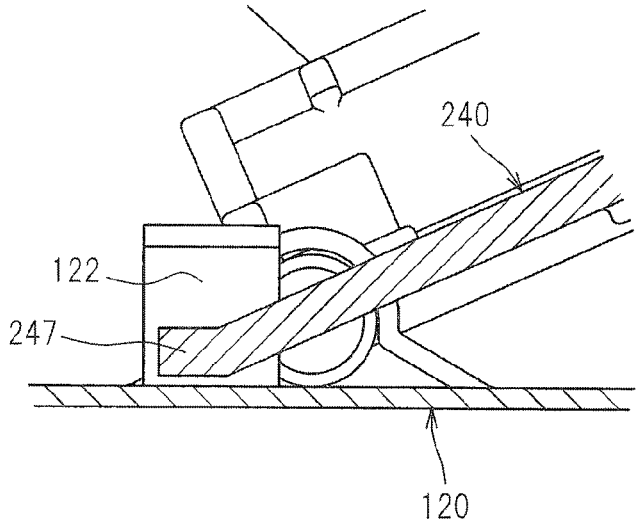
FIG. 14B is a sectional view of the rotation restricting portion when located in a first position.

As shown in FIG. 14B, the bent portion of the rotation restricting portion 247 moves toward the upper surface of the bridging member 120 when the rear end portion of the lifting member 240 moves upward. If the rear end portion of the lifting member 240 moves upward greatly, the rotation restricting portion 247 contacts the upper surface of the bridging member 120 to restrict the rotation of the lifting member 240. This prevents the lifting member 240 from rotating excessively and getting damaged.

The above embodiment shows, but is not limited to, that the bridging member 120 constitutes at least a part of the bottom surface of the main body. The bridging member 120 may constitute the entire bottom surface of the main body 2.

The above embodiment shows, but is not limited to, that the bridging member 120 connects some parts of the rear end portions of the side frames 110. The bridging member 120 may connect the entire of the side frames 110 or some parts of the front end portions of the side frames 110.

The above embodiment shows, but is not limited to, that the guide members 230 are exposed to the bottom surface of the main body 2. The guide members 230 may not be exposed to the bottom surface of the main body 2.

The sheets P, as an example of recording sheets, may include thick paper, postcards, thin paper, and transparencies.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming portion configured to form an image on a recording sheet;

a main body including a pair of frames and a bridging member, the pair of frames facing each other with the image forming portion there between, the bridging member connecting the pair of frames, the bridging member having a lower surface exposed to an outside of the image forming apparatus;

a feed roller;

a sheet receiving plate configured to receive the recording sheet, and pivot between a nearby position where the sheet receiving plate is disposed near the feed roller and a remote position where the sheet receiving plate is disposed remote from the feed roller; and a lifting member disposed under the sheet receiving plate, the lifting member being configured to lift the sheet receiving plate such that the sheet receiving plate is disposed in the nearby position, the lifting member including a pivot shaft and a lift portion disposed downstream from the pivot shaft in a sheet conveying direction, the pivot shaft being rotatably supported by the bridging member, the lift portion being configured to contact a lower surface of the sheet receiving plate, wherein the bridging member covers, from below, a portion of the lower surface of the sheet receiving plate disposed immediately above the pivot shaft of the lifting member, the lower surface of the sheet receiving plate including an exposed portion downwardly exposed to the outside of the image forming apparatus without being covered by the bridging member.

2. The image forming apparatus according to claim 1, wherein the sheet receiving plate has a first end portion and a second end portion opposite to the first end portion, the sheet receiving plate is configured to pivot about the first end portion, the second end portion faces the feed roller, the second end portion is disposed near the feed roller when the sheet receiving plate is in the nearby position, and the second end portion is disposed remote from the feed roller when the sheet receiving plate is in the remote position, and wherein the lifting member is configured to pivot about the pivot shaft between a first position where the sheet receiving plate is lifted and disposed in the nearby position and a second position where the sheet receiving plate is disposed in the remote position, when the lifting member pivots from the second position to the first position, the lift portion contacts and lifts the recording sheet receiving plate.

3. The image forming apparatus according to claim 2, wherein the lift portion contacts the lower surface of the sheet receiving plate at a position overlapping the feed roller in a thickness direction of the sheet receiving plate.

4. The image forming apparatus according to claim 2, wherein the bridging member connects a part, disposed proximate to the first end portion of the sheet receiving plate, of each of the pair of frames.

5. The image forming apparatus according to claim 4, further comprising an exposure unit holding member disposed in a portion, disposed proximate to the second end portion of the sheet receiving plate, of the main body, the exposure holding member connecting the pair of frames and being configured to hold an exposure unit.

6. The image forming apparatus according to claim 4, further comprising a guide member configured to guide the recording sheet fed by the feed roller to the image forming portion, the guide member connecting a side, proximate to the first end portion of the sheet receiving plate, of each of the pair of frames to one another.

7. The image forming apparatus according to claim 2, wherein the bridging member is shaped like a flat plate, and wherein an edge of the second end portion of the sheet receiving plate disposed in the nearby position overlaps the bridging member as viewed along a flat surface of the bridging member.

8. The image forming apparatus according to claim 1, wherein the lift portion is disposed in a position corresponding to the feed roller in a width direction of the sheet receiving plate.

9. The image forming apparatus according to claim 1, wherein the lift portion contacts a central portion of the lower surface of the sheet receiving plate in a width direction thereof.

10. The image forming apparatus according to claim 9, wherein the sheet receiving plate is made of resin.

11. The image forming apparatus according to claim 9, wherein the lifting member includes a connection portion connecting the pivot shaft and the lift portion, and a main portion extending from the connection portion toward one of the pair of frames, and wherein the image forming apparatus further comprises a drive mechanism disposed in an end portion of the main body opposite from the connection portion and configured to drive the lift member.

12. The image forming apparatus according to claim 11, wherein the connection portion and the main portion are made of sheet metal, and wherein the main portion has a first end portion proximate to the connection portion, which is larger than a second end portion opposite to the first end portion.

13. The image forming apparatus according to claim 12, wherein the main portion extends along an axis of the lifting member and includes a reinforcing portion protruding in a thickness direction of the lifting member.

14. The image forming apparatus according to claim 1, wherein the lifting member includes a rotation restricting portion configured to contact the bridging member to restrict rotation of the lifting member.

15. The image forming apparatus according to claim 1, wherein the sheet receiving plate includes a pair of guide members configured to adjust a position of the recording sheet received on the sheet receiving plate in a width direction of the recording sheet, and wherein the pair of guide members are partially exposed from the exposed portion of the lower surface of the sheet receiving plate downwardly to the outside of the image forming apparatus.

16. The image forming apparatus according to claim 1, wherein the bridging member is made of sheet metal.

17. The image forming apparatus according to claim 1, wherein the pivot shaft is made of resin and has a circular cross section.

18. The image forming apparatus according to claim 1, wherein, when the sheet receiving plate is in the remote position, the lower surface of the bridging member and the exposed portion of the lower surface of the sheet receiving plate, which are downwardly exposed to the outside of the image forming apparatus, constitute a lower surface of the image forming apparatus.

19. An image forming apparatus comprising:

an image forming portion configured to form an image on a recording sheet;

a main body including a pair of frames and a bridging member, the pair of frames facing each other with the image forming portion therebetween, the bridging member connecting the pair of frames, the bridging member having a lower surface exposed to an outside of the image forming apparatus;

a feed roller;

a sheet receiving plate configured to receive the recording sheet, and pivot between a nearby position where the sheet receiving plate is disposed near the feed roller and a remote position where the sheet receiving plate is disposed remote from the feed roller; and a lifting member disposed under the sheet receiving plate and rotatably supported by the bridging member, the lifting member being configured to lift the sheet receiving plate such that the sheet receiving plate is disposed in the nearby position, the lifting member having a pivot axis and including a lift portion, the lift portion being disposed downstream from the pivot axis in a sheet conveying direction and configured to contact a lower surface of the sheet receiving plate, wherein the bridging member covers, from below, a portion of the lower surface of the sheet receiving plate disposed immediately above the pivot axis of the lifting member, the lower surface of the sheet receiving plate including an exposed portion downwardly exposed to the outside of the image forming apparatus without being covered by the bridging member.

20. The image forming apparatus according to claim 19, wherein, when the sheet receiving plate is in the remote position, the lower surface of the bridging member and the exposed portion of the lower surface of the sheet receiving plate, which are downwardly exposed to the outside of the image forming apparatus, constitute a lower surface of the image forming apparatus.

* * * * *